US007967480B2

(12) United States Patent
Pickard et al.

(10) Patent No.: US 7,967,480 B2
(45) Date of Patent: Jun. 28, 2011

(54) LIGHTING FIXTURE

(75) Inventors: Paul Kenneth Pickard, Morrisville, NC (US); James Michael Lay, Cary, NC (US); Gary David Trott, Morrisville, NC (US)

(73) Assignee: Cree, Inc., Durham, NC (US)

( * ) Notice: Subject to any disclaimer, the term of this patent is extended or adjusted under 35 U.S.C. 154(b) by 285 days.

(21) Appl. No.: 12/114,994

(22) Filed: May 5, 2008

(65) Prior Publication Data

US 2008/0304269 A1 Dec. 11, 2008

Related U.S. Application Data

(63) Continuation-in-part of application No. 29/279,589, filed on May 3, 2007, now Pat. No. Des. 571,944, and a continuation-in-part of application No. 29/284,294, filed on Sep. 5, 2007, now Pat. No. Des. 596,330.

(60) Provisional application No. 60/916,030, filed on May 4, 2007.

(51) Int. Cl.
*F21V 15/00* (2006.01)

(52) U.S. Cl. ..... 362/362; 362/372; 362/364; 362/370

(58) Field of Classification Search ..... 248/343, 248/34, 323, 200.1, 905, 57; 362/148, 365, 362/370

See application file for complete search history.

(56) References Cited

U.S. PATENT DOCUMENTS

| | | | | |
|---|---|---|---|---|
| 3,052,749 A | | 9/1962 | Milton et al. | |
| 3,263,023 A | | 7/1966 | Staley | |
| 3,518,420 A | * | 6/1970 | Kripp | 362/257 |
| 4,165,851 A | | 8/1979 | Bowden, Jr. et al. | |
| 4,388,677 A | | 6/1983 | Druffel | |
| 4,564,165 A | * | 1/1986 | Grant et al. | 248/343 |
| 4,689,442 A | | 8/1987 | Ozaki | |
| 5,116,689 A | | 5/1992 | Castro et al. | |
| 5,386,959 A | | 2/1995 | Laughlin et al. | |
| 5,588,737 A | | 12/1996 | Kusmer | |
| 5,725,302 A | | 3/1998 | Sirkin | |

(Continued)

FOREIGN PATENT DOCUMENTS

JP 09-055457 2/1997

(Continued)

OTHER PUBLICATIONS

U.S. Appl. No. 11/939,059, filed Nov. 13, 2007.

(Continued)

*Primary Examiner* — Anabel M Ton
(74) *Attorney, Agent, or Firm* — Burr & Brown

(57) ABSTRACT

A lighting fixture comprises a mounting assembly and two rails. At least one of the rails is slidable relative to the mounting assembly. The rails are each extruded, and have profiles which are substantially similar to each other. Each rail has a male component which fits within a female component of the other. Also, a fixture comprising a mounting assembly comprising an opening through which a light engine housing can be inserted, and (1) a spring clip and/or (2) a clip engagement structure. Also, a fixture comprising a mounting assembly, a first set of rails, and a supplemental rail. The supplemental rail is slidable relative to the light emitting element mounting assembly. Also, a fixture comprising a mounting assembly, a set of rails, and an engagement element having a first portion being in contact with a first rail and a second portion in contact with the second rail.

23 Claims, 11 Drawing Sheets

U.S. PATENT DOCUMENTS

| | | | | |
|---|---|---|---|---|
| 5,876,831 | A | 3/1999 | Rawal | |
| 5,934,788 | A | 8/1999 | Wolfe | |
| 5,957,574 | A * | 9/1999 | Hentz et al. | 362/365 |
| D417,305 | S | 11/1999 | Pahl | |
| D417,306 | S | 11/1999 | Pahl | |
| D417,307 | S | 11/1999 | Pahl | |
| D417,746 | S | 12/1999 | Pahl | |
| D417,747 | S | 12/1999 | Pahl | |
| 6,033,098 | A * | 3/2000 | Hentz et al. | 362/430 |
| 6,045,240 | A | 4/2000 | Hochstein | |
| 6,076,788 | A | 6/2000 | Akiyama | |
| 6,095,671 | A | 8/2000 | Hutain | |
| 6,278,607 | B1 | 8/2001 | Moore et al. | |
| 6,441,943 | B1 | 8/2002 | Roberts et al. | |
| 6,482,520 | B1 | 11/2002 | Tzeng | |
| 6,659,632 | B2 | 12/2003 | Chen | |
| 6,740,972 | B2 | 5/2004 | Smith et al. | |
| 6,788,541 | B1 | 9/2004 | Hsiung | |
| 6,789,921 | B1 | 9/2004 | Deloy et al. | |
| 6,791,257 | B1 | 9/2004 | Sato et al. | |
| 6,800,932 | B2 | 10/2004 | Lam et al. | |
| 6,805,474 | B2 | 10/2004 | Walser et al. | |
| 6,864,573 | B2 | 3/2005 | Robertson et al. | |
| 6,880,954 | B2 | 4/2005 | Ollett et al. | |
| 6,949,772 | B2 | 9/2005 | Shimizu et al. | |
| 7,030,486 | B1 | 4/2006 | Marshall | |
| 7,095,110 | B2 | 8/2006 | Arik et al. | |
| 7,121,688 | B2 | 10/2006 | Rempel | |
| 7,144,140 | B2 | 12/2006 | Sun et al. | |
| 7,210,832 | B2 | 5/2007 | Huang | |
| 7,226,189 | B2 | 6/2007 | Lee et al. | |
| 7,234,674 | B2 * | 6/2007 | Rippel et al. | 248/343 |
| 7,234,844 | B2 | 6/2007 | Bolta et al. | |
| 7,258,475 | B2 | 8/2007 | Kurumatani | |
| 7,284,874 | B2 | 10/2007 | Jeong et al. | |
| 7,510,159 | B2 * | 3/2009 | Rippel | 248/343 |
| 7,651,238 | B2 * | 1/2010 | O'Brien | 362/148 |
| 7,654,495 | B2 * | 2/2010 | Adrian et al. | 248/200.1 |
| 7,699,488 | B2 * | 4/2010 | Drees | 362/147 |
| 2003/0006353 | A1 | 1/2003 | Dinh et al. | |
| 2004/0105247 | A1 | 6/2004 | Calvin et al. | |
| 2005/0051789 | A1 | 3/2005 | Negley et al. | |
| 2005/0077525 | A1 | 4/2005 | Lynch et al. | |
| 2005/0094105 | A1 | 5/2005 | Otsuka et al. | |
| 2005/0128751 | A1 | 6/2005 | Roberge et al. | |
| 2005/0174780 | A1 | 8/2005 | Park | |
| 2005/0237739 | A1 | 10/2005 | Lee et al. | |
| 2005/0247842 | A1 | 11/2005 | Wronski | |
| 2006/0061539 | A1 | 3/2006 | Song et al. | |
| 2006/0098440 | A1 | 5/2006 | Allen | |
| 2006/0187660 | A1 | 8/2006 | Liu | |
| 2006/0243877 | A1 | 11/2006 | Rippel | |
| 2007/0019418 | A1 * | 1/2007 | Czech et al. | 362/364 |
| 2007/0074755 | A1 | 4/2007 | Eberspacher et al. | |

FOREIGN PATENT DOCUMENTS

| | | |
|---|---|---|
| JP | 11-264668 | 9/1999 |
| WO | 2008079161 | 7/2008 |

OTHER PUBLICATIONS

Cree, Inc., "Cree® Xlamp® 7090 XR-E Series LED Binning and Labeling," Application Note: CLD-AP08.000, 7pp (2006).

Cree, Inc., "Cree® Xlamp® 7090 XR-E Series LED Data Sheet," Datasheet: CLD-DS05.000, 10 pp (2006).

Cree, Inc., "Cree® Xlamp® 7090 XR-E Series LED Secondary Optics," Datasheet: CLD-DS07.000, 3 pp (2004-2006).

McMaster-Carr Supply Company, "Multipurpose Aluminum (Alloy 6061), specification sheets," Retrieved Dec. 14, 2006 from www.mcmaster.com/param/asp/Psearch2.asp?regTyp=parametric &act=psearch%F.., 3 pp.

U.S. Appl. No. 11/613,692, filed Dec. 20, 2006.
U.S. Appl. No. 11/614,180, filed Dec. 21, 2006.
U.S. Appl. No. 11/613,733, filed Dec. 20, 2006.
U.S. Appl. No. 11/624,811, filed Jan. 19, 2007.
U.S. Appl. No. 11/743,754, filed May 3, 2007.
U.S. Appl. No. 11/751,982, filed May 22, 2007.
U.S. Appl. No. 11/753,103, filed May 24, 2007.
U.S. Appl. No. 11/751,990, filed May 22, 2007.
U.S. Appl. No. 11/736,761, filed Apr. 18, 2007.
U.S. Appl. No. 11/755,153, filed May 30, 2007.
U.S. Appl. No. 11/856,421, filed Sep. 17, 2007.
U.S. Appl. No. 11/859,048, filed Sep. 21, 2007.
U.S. Appl. No. 11/939,047, filed Nov. 13, 2007.
U.S. Appl. No. 11/843,243, filed Aug. 22, 2007.
U.S. Appl. No. 11/939,052, filed Nov. 13, 2007.
U.S. Appl. No. 11/736,799, filed Apr. 18, 2007.
U.S. Appl. No. 11/877,038, filed Oct. 23, 2007.
U.S. Appl. No. 11/870,679, filed Oct. 11, 2007.
U.S. Appl. No. 11/948,041, filed Nov. 30, 2007.
U.S. Appl. No. 29/279,589, filed May 3, 2007.
U.S. Appl. No. 12/116,341, filed May 7, 2008.
U.S. Appl. No. 12/117,148, filed May 8, 2008.
U.S. Appl. No. 29/284,294, filed Sep. 5, 2007.
U.S. Appl. No. 12/017,676, filed Jan. 22, 2008.
U.S. Appl. No. 12/277,745, filed Nov. 25, 2008.
U.S. Appl. No. 12/116,346, filed May 7, 2008.
U.S. Appl. No. 11/673,951, filed Feb. 12, 2007.
U.S. Appl. No. 11/379,709, filed Apr. 21, 2006.
U.S. Appl. No. 11/379,726, filed Apr. 21, 2006.
U.S. Appl. No. 11/408,767, filed Apr. 21, 2006.

Prescolite Architektur LED Downlights (Sep. 2006) 8 pages.

* cited by examiner

FIG.5
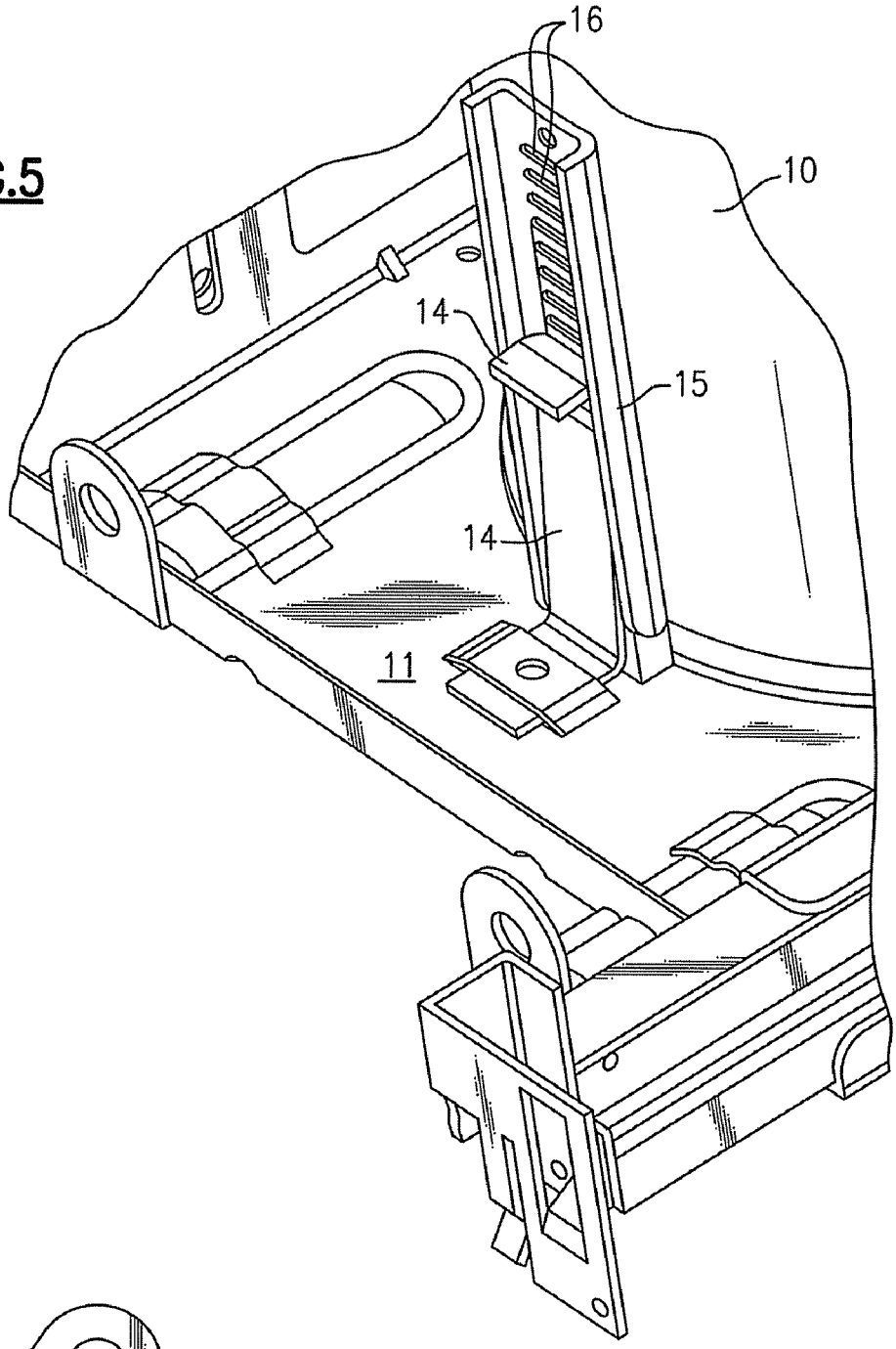
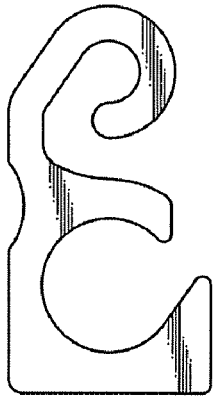
FIG.6

LIGHTING FIXTURE

CROSS-REFERENCE TO RELATED APPLICATIONS

This application is a continuation-in-part of U.S. Design patent application No. 29/279,589, filed May 3, 2007 (now U.S. Design Pat. No. D571,944 issued Jun. 24, 2008).

This application is a continuation-in-part of U.S. Design patent application No. 29/284,294, filed Sept. 5, 2007 (now U.S. Design Pat. No. D596,330 issued Jul. 14, 2009).

This application claims the benefit of U.S. Provisional Patent Application No. 60/916,030, filed May 4, 2007, the entirety of which is incorporated herein by reference.

FIELD OF THE INVENTION(S)

The present inventive subject matter relates to a lighting fixture. In some embodiments, as discussed below, the present inventive subject matter relates to a downlight lighting fixture (e.g., a "can" lighting fixture, also referred to as a recessed lighting fixture).

BACKGROUND OF THE INVENTION(S)

A large proportion (some estimates are as high as twenty-five percent) of the electricity generated in the United States each year goes to lighting. Accordingly, there is an ongoing need to provide lighting fixtures (1) which are easier to install, (2) which reduce the possibility of injury during installation, repair, maintenance, replacement and/or removal, and/or (3) which make it possible for the lighting fixture to be held more securely in place.

In addition, with the growing popularity of lighting elements which include solid state light emitters (e.g., light emitting diodes), there is an increasing demand for lighting fixtures (and components thereof) which facilitate the use of such lighting elements while maximizing the benefits obtained from using such lighting elements and minimizing or eliminating any drawbacks from using such lighting elements.

One example of a conventional recessed light fixture comprises a metal cylinder ("can") mounted into the ceiling using horizontal metal struts attached to the ceiling joints. Within the cylinder, mounted on an adjustable sliding plate, is light bulb socket into which a light bulb is inserted. Typically a 60 W incandescent light bulb or a 15 W compact fluorescent bulb is used. For example, a conventional recessed light fixture is depicted in FIG. 1.

In this conventional fixture, around the annulus of the bulb and extending downward to the lower inside edge of the cylinder is a baffle or reflecting cone. A cosmetic ring is placed around the bottom edge of the cylinder and extending outward to cover the area immediately surrounding the circular cutout in the ceiling and create an attractive edging around the light output aperture.

The position (height) of the bulb can be set such that the bulb is not directly visible to the people standing in the room and the light from the fixture is directed so that it principally illuminates an area below the fixture.

These fixtures are popular because they do not create significant glare (being recessed) and highlight objects situated below them.

In many cases (e.g., most residential applications), the "cans" are required to be substantially airtight around the sides and top to prevent the loss of ambient heat or cooling from the room into the ceiling cavity through the fixture. As the lamp is mounted in the can, much of the heat generated by the light source is trapped within the can, because the air heated in the can rises and is trapped within the can. Special insulation is usually required around the can within the ceiling cavity to prevent fire.

As indicated above, some aspects of the present inventive subject matter are directed to providing lighting fixtures which are suitable for use with light emitting elements which includes solid state light emitters. The environment inside a conventional can are described above is not ideal for solid-state lighting. LEDs, for example, have significant energy and lifetime benefits over incandescent and fluorescent light sources—LEDs, however, do not operate well in high temperatures. LED light sources have operating lifetimes of decades as opposed to just months or 1-2 years for many incandescent bulbs. An LED's lifetime is significantly shortened, however, if it operates at elevated temperatures. It is generally accepted that the junction temperature of an LED should not exceed 70 degrees C. if a long lifetime is desired.

Efficient individual LED light sources typically provide between 3 and 50 lumens of light per source (LED die or lamp) depending on the size of the LED die. A typical recessed downlight using a 60 W incandescent bulb provides about 500 lumens of light, so it can be seen that to provide a similar amount of light from LEDs, multiple LED light sources would be required.

To provide a similar amount of light using "small die" (typically 300 square micrometers), approximately 200 die would be required, or, alternatively using large "power" die (typically approximately 1 square millimeter) 10-20 die would be required.

For the above and other reasons, efforts have been ongoing to develop ways by which solid state light emitters can be used in place of incandescent lights, fluorescent lights and other light-generating devices in a wide variety of applications. In addition, where light emitting diodes (or other solid state light emitters) are already being used, efforts are ongoing to provide light emitting diodes (or other solid state light emitters) which are improved, e.g., with respect to energy efficiency, color rendering index (CRI Ra), contrast, efficacy (1 m/W), cost and/or duration of service.

BRIEF SUMMARY OF THE INVENTIVE SUBJECT MATTER

There are a variety of well-known lighting fixtures which are typically mounted by attaching support rails to construction elements (e.g., ceiling joists). Some aspects of the present inventive subject matter relate to devices and methods for mounting lighting fixtures using rails. In addition, there are a variety of considerations involved in mounting such fixtures, discussed in more detail below, which are affected by the use of lighting fixtures which include one or more solid state light emitters. Some aspects of the present inventive subject matter relate to devices and methods which address such considerations.

Also, there are a variety of well-known structures for use in mounting lighting fixtures in, on or in relation to construction elements (e.g., ceiling joists with sheetrock ceilings). Some aspects of the present inventive subject matter relate to devices and methods which simplify and/or improve various features of such mountings. In addition, the use of lighting fixtures which include one or more solid state light emitters can affect such mountings, and the present inventive subject matter provides devices and methods which are useful in mounting such lighting fixtures.

According to a first aspect of the present inventive subject matter, there is provided a lighting fixture comprising a light emitting element mounting assembly and at least a first set of rails. The first set of rails comprises a first rail and a second rail, the first rail and second rail each being connected to the light emitting element mounting assembly, at least one of the first rail and the second rail being slidable relative to the light emitting element mounting assembly. The first rail has a major dimension extending in a first direction and the second rail has a major dimension extending in a second direction, the first direction being substantially parallel to the second direction. The expression "major dimension", as used herein, means a dimension of a structure which is equal to or longer than the other dimensions of the structure. The first rail is slidable relative to the second rail along the first direction. The first rail and the second rail are each extruded (i.e., they are formed by extrusion). The first rail has a first profile, the first profile comprising a first profile male component and a first rail female component. The second rail has a second profile, the second profile comprising a second profile male component and a second rail female component. The first profile male component is positioned within the second profile female component, and the second profile male component is positioned within the first profile female component. The second profile is substantially similar to the first profile except for the first profile being rotated 180 degrees relative to the second profile.

In some embodiments according to this aspect of the present inventive subject matter, the first rail and the second rail each have a beam structure in both up-down and side-to-side bending.

In some embodiments according to this aspect of the present inventive subject matter, the first and second rails together have a combined external profile which is substantially rectangular.

In some embodiments according to this aspect of the present inventive subject matter, the first and second rails together have a combined external profile which is free from angles in excess of 90 degrees.

In some embodiments according to this aspect of the present inventive subject matter, the first rail female component extends greater than 180 degrees around the second rail male component, and the second rail female component extends greater than 180 degrees around the first rail male component.

In some embodiments according to this aspect of the present inventive subject matter, there is provided an engagement element which serves to inhibit (but not prevent) the rails from sliding relative to one another, such that the rails can be stretched to a desired extent and then attached to construction elements (e.g., ceiling joists), without having the engage set screws or the like. Accordingly, in some embodiments, the lighting fixture further comprises at least one engagement element, the engagement element being attached to the light emitting element mounting assembly, the engagement element comprising at least a first engagement element portion and a second engagement element portion, the first engagement element portion being in contact with a first portion of the first rail, the second engagement element portion being in contact with a first portion of the second rail. In some of such embodiments, the engagement element comprises a support element, a first pad and a second pad, the first pad being mounted on a first portion of the support element, the second pad being mounted on a second portion of the support element, the first pad comprising the first engagement element portion and being in contact with the first portion of the first rail, the second pad comprising the second engagement element portion and being in contact with the first portion of the second rail.

According to a second aspect of the present inventive subject matter, there is provided a lighting fixture comprising a light emitting element mounting assembly comprising an opening through which a light engine housing can be inserted, the light emitting element mounting assembly comprising at least one of (1) at least one spring clip and (2) at least one clip engagement structure, the clip engagement structure comprising at least one clip engagement region (e.g., a plurality of slots). For example, in some embodiments according to the present inventive subject matter, there is provided structure which makes it possible to insert the "can" through a "rough-in" which has been formed in a ceiling and securely hold the can in place.

In some embodiments according to this aspect of the present inventive subject matter, the lighting fixture further comprises a light emitting element received in the opening. In some of such embodiments, the light emitting element mounting assembly comprises at least a first spring clip, and the light emitting element comprises at least a first clip engagement structure, the first clip engagement structure comprising a plurality of clip engagement regions, the first spring clip engaging one of the clip engagement regions. In others of such embodiments, the light emitting element comprises at least a first spring clip, and the light emitting element mounting assembly comprises at least a first clip engagement structure, the first clip engagement structure comprising a plurality of clip engagement regions, the first spring clip engaging one of the clip engagement regions. In some of such embodiments, at least a first pair of clip engagement regions are spaced from each other by a distance which is less than one-tenth of a major dimension of the light engine housing.

According to a third aspect of the present inventive subject matter, there is provided a lighting fixture comprising a light emitting element mounting assembly, at least a first set of rails, and at least a first supplemental rail. The first set of rails comprises a first rail and a second rail, the first rail and second rail each being connected to the light emitting element mounting assembly, at least one of the first rail and the second rail being slidable relative to the light emitting element mounting assembly. The first rail has a major dimension extending in a first direction, and the second rail has a major dimension extending in a second direction, the first direction being substantially parallel to the second direction. The first rail is slidable relative to the second rail along the first direction. The first supplemental rail is slidable relative to the light emitting element mounting assembly along a third direction which is parallel to the first direction.

In some embodiments according to this aspect of the present inventive subject matter, the lighting device can be easily mounted to construction element(s), e.g., in relatively tightly spaced joists (e.g., between 9" and 13"), by removing the rails and attaching the lighting device to the construction element(s) with the supplemental rail(s).

In some embodiments according to the present inventive subject matter, there is provided structure which makes it possible to keep the rails substantially stationary in relation to each other, when desired, without the need to use a screw to lock down the rails.

For instance, according to a fourth aspect of the present inventive subject matter, there is provided a lighting fixture comprising:

a light emitting element mounting assembly;

at least a first set of rails, the first set of rails comprising a first rail and a second rail, the first rail and second rail each being connected to the light emitting element mounting assembly, at least one of the first rail and the second rail being slidable relative to the light emitting element mounting assembly, the first rail having a major dimension extending in a first direction, the second rail having a major dimension extending in a second direction, the first direction being substantially parallel to the second direction, the first rail being slidable relative to the second rail along the first direction, and at least one engagement element, the engagement element being attached to the light emitting element mounting assembly, the engagement element comprising at least a first engagement element portion and a second engagement element portion, the first engagement element portion being in contact with a first portion of the first rail, the second engagement element portion being in contact with a first portion of the second rail.

In some embodiments according to this aspect of the present inventive subject matter, the engagement element comprises a support element, a first pad and a second pad, the first pad being mounted on a first portion of the support element, the second pad being mounted on a second portion of the support element, the first pad comprising the first engagement element portion and being in contact with the first portion of the first rail, the second pad comprising the second engagement element portion and being in contact with the first portion of the second rail. In some of such embodiments, the support element is spring biased such that the first pad exerts force on the first portion of the first rail and the second pad exerts force on the first portion of the second rail (and in some of such embodiments, the support element further comprises a tensioning element which can be tightened to increase the force exerted by the first pad on the first portion of the first rail and to increase the force exerted by the second pad on the first portion of the second rail). In others of such embodiments, the support element further comprises a tensioning element which can be tightened to cause the first pad to exert force on the first portion of the first rail and the second pad to exert force on the first portion of the second rail.

In some embodiments of the present inventive subject matter, there is provided a lighting fixture which comprises one or more solid state light emitters, e.g., one or more light emitting diodes (LEDs).

In some embodiments of the present inventive subject matter, there is provided a lighting fixture comprising a die-cast upper housing and a die-cast lower housing which can be utilized in multiple applications, an extruded heat sink mounted external to the fixture "can" for heat removal, and extruded aluminum profile rails.

BRIEF DESCRIPTION OF THE DRAWING FIGURES

FIG. 5 is a close-up view of a portion of the third embodiment.

FIG. 6 depicts a profile of an embodiment of a rail according to the present inventive subject matter.

DETAILED DESCRIPTION OF EMBODIMENTS OF THE INVENTIVE SUBJECT MATTER

Figure 1:
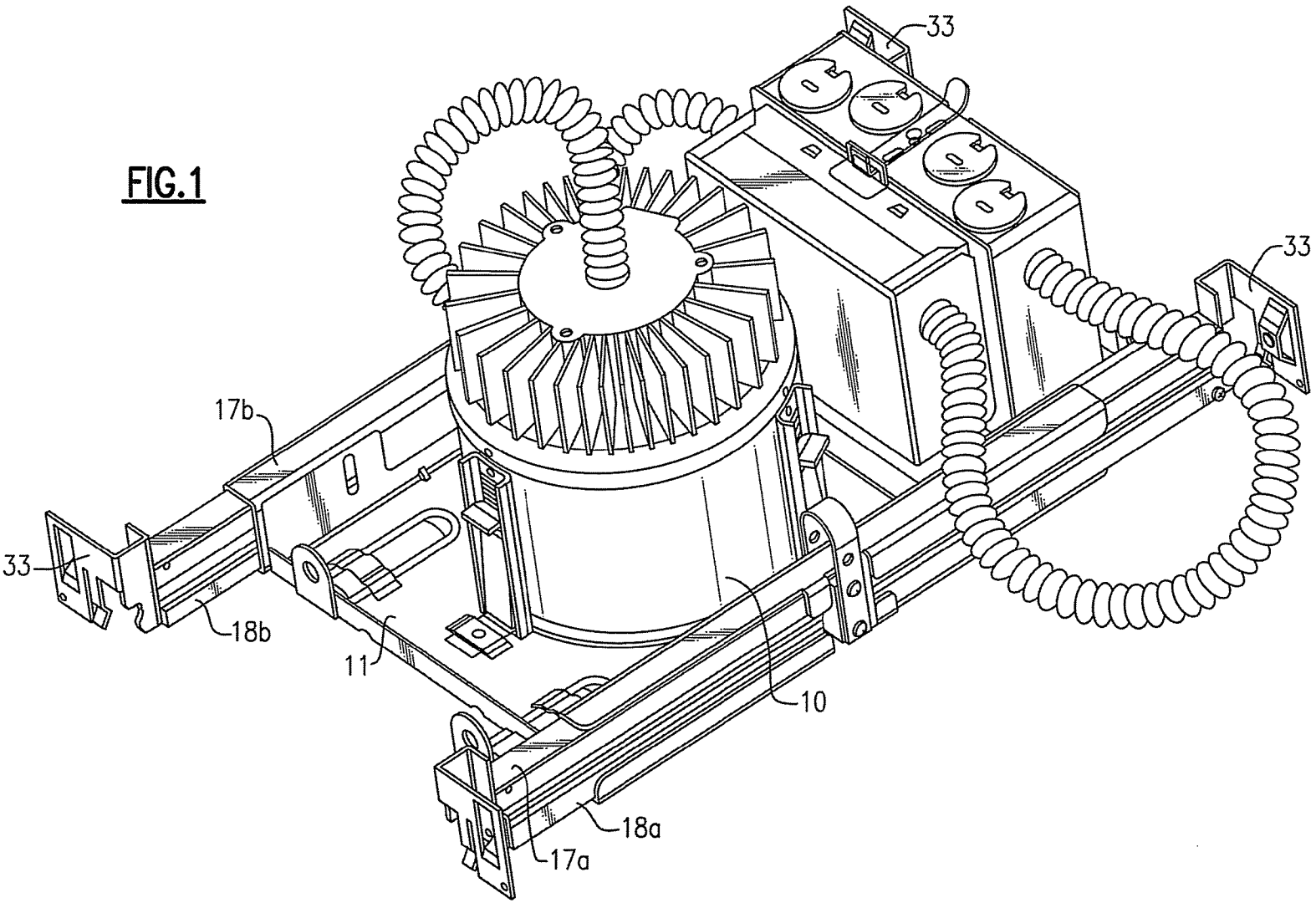
FIG. 1 depicts a first embodiment of a lighting fixture according to the present inventive subject matter.

The present inventive subject matter now will be described more fully hereinafter with reference to the accompanying drawings, in which embodiments of the inventive subject matter are shown. However, this inventive subject matter should not be construed as limited to the embodiments set forth herein. Rather, these embodiments are provided so that this disclosure will be thorough and complete, and will fully convey the scope of the inventive subject matter to those skilled in the art. Like numbers refer to like elements throughout. As used herein the term "and/or" includes any and all combinations of one or more of the associated listed items.

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

When an element such as a layer, region or substrate is referred to herein as being "on" or extending "onto" another element, it can be directly on or extend directly onto the other element or intervening elements may also be present. In contrast, when an element is referred to herein as being "directly on" or extending "directly onto" another element, there are no intervening elements present. Also, when an element is referred to herein as being "connected" or "coupled" to another element, it can be directly connected or coupled to the other element or intervening elements may be present. In contrast, when an element is referred to herein as being "directly connected" or "directly coupled" to another element, there are no intervening elements present.

Although the terms "first", "second", etc. may be used herein to describe various elements, components, regions, layers, sections and/or parameters, these elements, components, regions, layers, sections and/or parameters should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive subject matter.

Furthermore, relative terms, such as "lower" or "bottom" and "upper" or "top," may be used herein to describe one element's relationship to another elements as illustrated in the Figures. Such relative terms are intended to encompass different orientations of the device in addition to the orientation depicted in the Figures. For example, if the device in the Figures is turned over, elements described as being on the "lower" side of other elements would then be oriented on "upper" sides of the other elements. The exemplary term "lower", can therefore, encompass both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

The expression "light emitting element", as used herein, is not limited, except that it indicates that the element is capable of emitting light. That is, a lighting device can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulbs or bulb replacements (e.g., for replacing AC incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting—work lights, etc., mirrors/vanity lighting, or any other light emitting device.

The expression "light emitting diode" is used herein to refer to the basic semiconductor diode structure (i.e., the chip). The commonly recognized and commercially available "LED" that is sold (for example) in electronics stores typically represents a "packaged" device made up of a number of parts. These packaged devices typically include a semiconductor based light emitting diode such as (but not limited to) those described in U.S. Pat. Nos. 4,918,487; 5,631,190; and 5,912,477; various wire connections, and a package that encapsulates the light emitting diode.

The expression "substantially rectangular", as used herein, means that a rectangular shape can be identified, wherein at least 70% (and in some cases at least 80%) of the points in the perimeter of the item which is characterized as being substantially rectangular fall within the rectangular shape, and the rectangular shape includes at least 70% (and in some cases at least 80%) of the points in the item.

The expression "substantially parallel" means that two lines (or two planes) diverge from each other at most by an angle of 5 degrees.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

As mentioned above, according to a first aspect of the present inventive subject matter, there is provided a lighting fixture comprising a light emitting element mounting assembly and at least a first set of rails.

Figure 3:
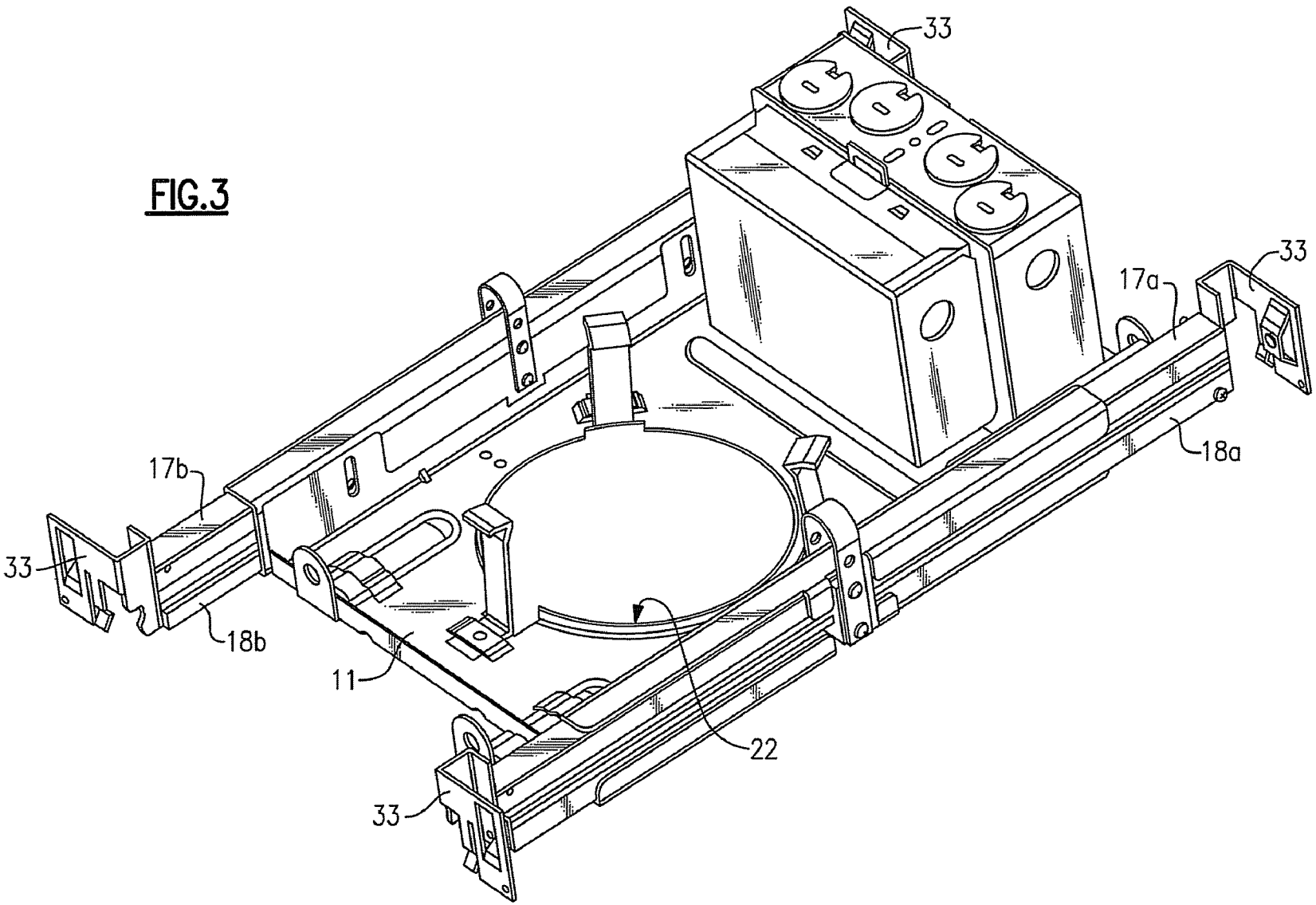
FIG. 3 depicts a second embodiment of a lighting fixture according to the present inventive subject matter.

The light emitting element mounting assembly can be formed of any suitable material or materials, and can take any suitable shape. In some embodiments, the light emitting element mounting assembly provides receiving structure, i.e., structure to which a light emitting element, e.g., a conventional light emitting element, can readily be attached. For example, FIG. 3 depicts a lighting fixture which includes a light emitting element mounting assembly 11 (and two sets of rails 17*a*, 18*a* and 17*b*, 18*b*), and the light emitting element mounting assembly 11 includes a receiving structure in the form of an opening 22. FIG. 1 depicts an embodiment which is similar to the embodiment shown in FIG. 3, except that in the embodiment shown in FIG. 1, a light emitting element (in the form of a can 10) is positioned within the opening 22.

As described above, the first set of rails comprises a first rail and a second rail, the first rail and second rail each being connected to the light emitting element mounting assembly, at least one of the first rail and the second rail being slidable relative to the light emitting element mounting assembly. The first rail has a major dimension extending in a first direction and the second rail has a major dimension extending in a second direction, the first direction being substantially parallel to the second direction. For example, in the embodiment depicted in FIG. 3, the first rails 17*a* and 17*b*, and the second rails 18*a* and 18*b*, have respective major dimensions extending in directions which are all parallel (namely, in the orientation shown in FIG. 7, perpendicularly into and perpendicularly out of the plane of the page).

The rails can individually be formed of any suitable desired material or combination of materials. A representative example of a material out of which the rails can be formed is aluminum. In some embodiments, the rails are snugly fitted to one another, i.e., there is very little space between the rails where the rails abut one another, which contributes to the rigidity of the rails in combination. In some embodiments, the rails can be anodized in order to prevent or minimize binding between the rails. Methods of anodizing are well-known to persons of skill in the art, and any such methods can be employed according to the present inventive subject matter. In any case, in some embodiments, effort can be exerted to eliminate or reduce the quantity of any metal shavings or other particles between the rails or in contact with either of the rails.

As described above, the first rail and the second rail each have at least one male component and at least one female component, with the male component of the first rail being positioned within the female component of the second rail, and the male component of the second rail being positioned within the female component of the first rail. As seen most easily from FIG. 7, because of this and because the first rail and the second rail are formed from the same extrusion, the profile of the first and second rails are substantially similar, except that they are rotated 180 degrees relative to each other.

The expression "profile," as used in the preceding paragraph and throughout the present specification, means a cross-section of a rail, where the cross-section is substantially identical along a significant portion of the length of the rail along its major dimension. In other words, if sectional views of the rails are drawn for the rails at 100 equally spaced intervals along an axis extending along the major dimension of the rails (i.e., into and out of the page in FIG. 7), most (e.g., at least 90, at least 95 or all) of the sectional views would be substantially identical.

As noted above, in some embodiments according to this aspect of the present inventive subject matter, the first rail and the second rail each have a beam structure in both up-down and side-to-side bending. Examples of such beam structures are most readily seen in FIG. 12, which is a copy of FIG. 7, modified by showing the side-to-side beam structures with dotted lines 23 and by showing the up-down beam structures with dotted lines 24.

As noted above, in some embodiments according to this aspect of the present inventive subject matter, the first and second rails together have a combined external profile which is substantially rectangular. An example of such a combined external profile is most readily seen in FIG. 7, where the perimeter of the structure depicted is, for purposes of the present specification, substantially rectangular.

In some embodiments according to this aspect of the present inventive subject matter, the first rail female component extends greater than 180 degrees around the second rail male component, and the second rail female component extends greater than 180 degrees around the first rail male component. An example of an embodiment which satisfies this feature is most readily seen in FIG. 12, where an axis 25 within the female component of the first rail 17 is surrounded on more than 50% of radial directions (i.e., more than 180 degrees) extending therefrom, whereby the male component of the second rail 18 cannot slip out of the female component of the first rail 17 in any direction other than along its major axis (and, likewise, an axis 26 within the female component of the second rail 18 is surrounded on more than 50% of radial directions (i.e., more than 180 degrees) extending therefrom, whereby the male component of the first rail 17 cannot slip out of the female component of the second rail 17 in any direction other than along its major axis).

In some embodiments according to this aspect of the present inventive subject matter, each of the rails has at least one mounting plate attached to one end, such that the mounting plates can be attached to a construction element, e.g., a joist. For example, the rails in FIG. 3 each have a mounting plate 33 attached to one of their ends. The mounting plates 33 can be attached to a construction element by, e.g., inserting a screw through a hole in the mounting plate and then into the construction element.

In some embodiments according to this aspect of the present inventive subject matter, the lighting fixture further comprises a receiving structure to which a light emitting element can be connected.

In some embodiments according to this aspect of the present inventive subject matter, the lighting fixture further comprises a light emitting element. The light emitting element can be any desired light emitting element, i.e., it can be a housing on which there are mounted solid state light emitters, incandescent light bulbs, fluorescent lights, etc., and/or receptacles for such items.

Figure 15:
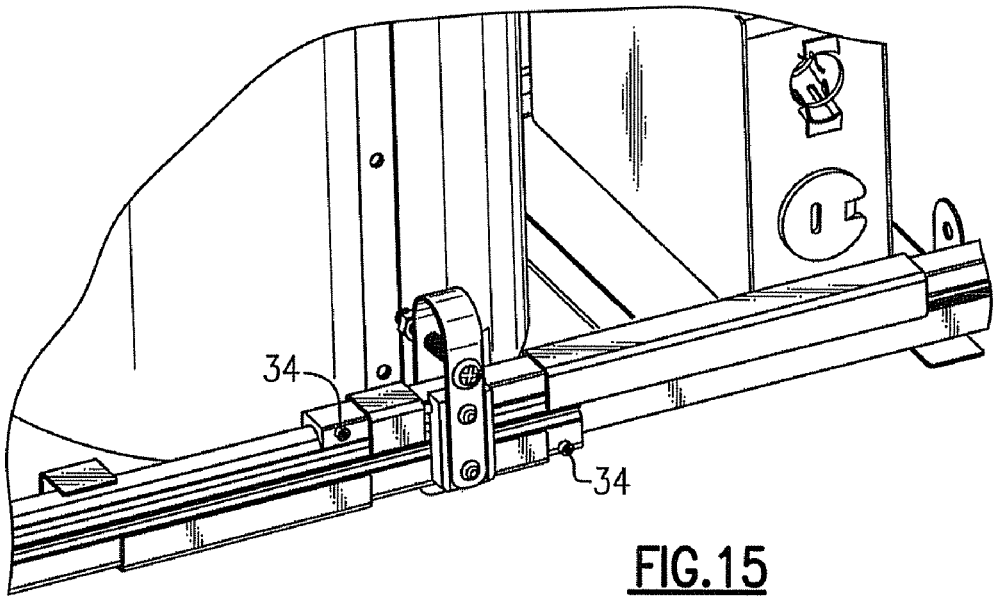
FIG. 15 depicts a portion of an embodiment of a lighting fixture which includes stops.

In some embodiments according to this aspect of the present inventive subject matter, there is/are further provided one or more stops which prevent the first profile male component from sliding completely out of the second profile female component and which prevent the second profile male component from sliding completely out of the first profile female component. Persons of skill in the art are readily capable of providing stops to inhibit or prevent the male components from sliding completely out of the respective female components, and any such structures are included within the scope of the present inventive subject matter. For instance, FIG. 15 depicts a portion of a lighting fixture which includes stops 34.

In some embodiments according to this aspect of the present inventive subject matter, the first and second rails together have a combined external profile which is free from angles in excess of 90 degrees. In other words, most of the lengths of the rails are relatively smooth, i.e., free from sharp edges. For purposes of the present specification, an edge having two parallel surfaces and a thickness of less than 1/16 inch is considered to be a single angle (and not two angles of 90 degrees), and therefore, for purposes of this description, has an angle of about 180 degrees (i.e., in embodiments in which the combined external profile is free from angles in excess of 90 degrees, there are no instances in which an exposed edge having two parallel surfaces has a thickness of less than 1/16 inch.

As noted above, in some embodiments according to this aspect of the present inventive subject matter, there is provided an engagement element which serves to inhibit (but not prevent) the rails from sliding relative to one another, such that the rails can be stretched to a desired extent and then attached to construction elements (e.g., ceiling joists), without having the engage set screws or the like. Such an engagement element can be any structure which is effective to inhibit the rails from sliding relative to one another, including engagement elements as described herein in connection with the second aspect of the present inventive subject matter.

As noted above, according to a second aspect of the present inventive subject matter, there is provided a lighting fixture comprising a light emitting element mounting assembly comprising an opening through which a light engine housing can be inserted, the light emitting element mounting assembly comprising at least one of (1) at least one spring clip and (2) at least one clip engagement structure, the clip engagement structure comprising at least one clip engagement region. For example, in some embodiments according to the present inventive subject matter, there is provided structure which makes it possible to insert the "can" through a "rough-in" which has been formed in a ceiling and securely hold the can in place with the light emitting element mounting assembly.

In embodiments which include one or more clip engagement structures which comprise multiple clip engagement regions, at least some of the clip engagement regions can, in some instances, be positioned close enough to each other (e.g., spaced by 1/8 inch) that the light emitting element can be positioned in a desired location relative to one or more construction elements (e.g., a sheetrock ceiling). In some embodiments, the precise position of a trim provided in the light emitting element can be adjusted to be more precisely positioned relative to the construction element(s).

The descriptions above relating to light emitting element mounting assemblies are applicable to the light emitting element mounting assemblies in this aspect of the present inventive subject matter.

The spring clip and/or the clip engagement structure can be any suitable respective structures for holding a light emitting element (when present) in place relative to the light emitting element mounting assembly.

As noted above, in some embodiments according to this aspect of the present inventive subject matter, the lighting fixture further comprises a light emitting element received in the opening.

In some embodiments which include a light emitting element received in the opening, the light emitting element mounting assembly comprises at least a first spring clip, and the light emitting element comprises at least a first clip engagement structure, the first clip engagement structure comprising a plurality of clip engagement regions, the first spring clip engaging one of the clip engagement regions. Representative examples of such embodiments are depicted in FIGS. 1-5 and 11. In some of such embodiments, (1) the spring clip (or clips) comprises an element which is rigidly attached to the light emitting element mounting assembly, which is biased toward the center of the opening (but can be flexed outwardly), and which has a protruding region facing toward the center of the opening, and (2) the clip engagement structure (or respective clip engagement structures) is rigidly attached to the light emitting element and has a series of clip engagement regions (each in the form of a slot into which the protruding region of the respective spring clip can enter as a result of the spring bias of the clip). Where multiple spring clips and corresponding clip engagement structures are provided, they can be spaced around the opening such that each spring clip will be in registry with its corresponding clip engagement structure when the light emitting element is correctly positioned. The embodiments depicted in FIGS. 1-5 and 11 include plural spring clips and corresponding clip engagement structures of this type.

Figure 13:
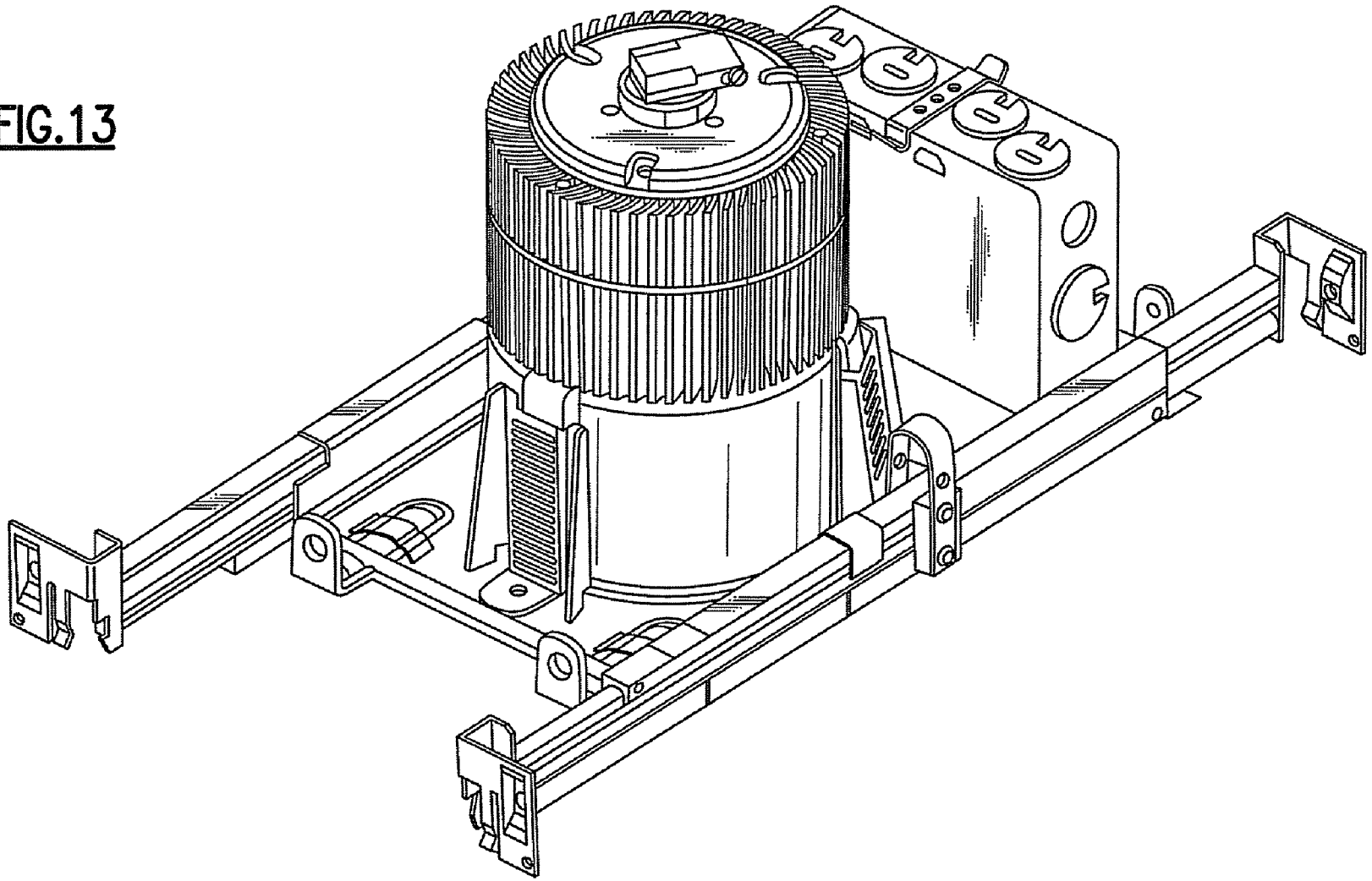
FIG. 13 depicts an embodiment of a lighting fixture according to the present inventive subject matter.

In some embodiments which include a light emitting element received in the opening, the light emitting element comprises at least a first spring clip, and the light emitting element mounting assembly comprises at least a first clip engagement structure, the first clip engagement structure comprising a plurality of clip engagement regions, the first spring clip engaging one of the clip engagement regions. A representative example of such an embodiment is depicted in FIG. 13. In some of such embodiments, (1) the spring clip (or clips) comprises an element which is rigidly attached to the light emitting element, which is biased outward from the center of the opening (but can be flexed inwardly), and which has a protruding region facing away from the center of the opening, and (2) the clip engagement structure (or respective clip engagement structures) is rigidly attached to the light emitting element mounting assembly and has a series of clip engagement regions (each in the form of a slot into which the protruding region of the respective spring clip can enter as a result of the spring bias of the clip). Where multiple spring clips and corresponding clip engagement structures are provided, they can be spaced around the opening such that each spring clip will be in registry with its corresponding clip engagement structure when the light emitting element is correctly positioned. The embodiment depicted in FIG. 13 includes plural spring clips and corresponding clip engagement structures of this type.

The engagement between the spring clips and the clip engagement structures is strong enough to hold the light emitting element securely in the light emitting element mounting assembly.

The spring clips and the clip engagement structures can be made of any suitable material or materials, and persons of skill in the art are readily able to select materials which would be desirable for any given situations. In some embodiments, the spring clips and the clip engagement structures can be made of the same material as the structure to which they are attached.

The increased rigidity which can be provided by structures as described above in connection with the first aspect of the present inventive subject matter can be on importance in connection with a device in accordance with the second aspect of the present inventive subject matter, in that the structures according to the first aspect of the present inventive subject matter can provide excellent rigidity of the rails, which can be important in maintaining the positioning of the light emitting element mounting assembly (and ultimately also the light emitting element) when exerting the force required to push the light emitting element into place (which force can in some instances be considerable).

The light emitting element mounting assemblies according to this aspect of the present inventive subject matter can further include rails (and/or supplemental rails), and the descriptions herein regarding such rails and supplemental rails apply to such embodiments.

As noted above, according to a third aspect of the present inventive subject matter, there is provided a lighting fixture comprising a light emitting element mounting assembly, at least a first set of rails, and at least a first supplemental rail.

Figure 11:
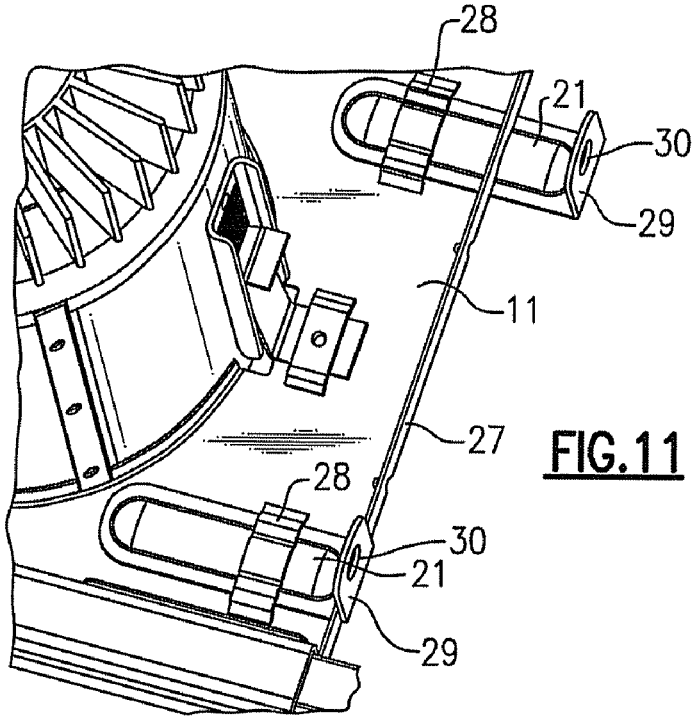
FIG. 11 depicts an embodiment of a lighting fixture according to the present inventive subject matter.

The descriptions of rails herein are applicable to the rails in this aspect of the present inventive subject matter. Likewise, the descriptions of light emitting element mounting assemblies herein are applicable to the light emitting element mounting assemblies in this aspect of the present inventive subject matter. The one or more supplemental rails can be made of any suitable material or materials. The supplemental rails can be slidably attached to the light emitting element mounting assembly in any desired manner. Persons skilled in the art are familiar with a variety of ways to slidable attach such rails to a mounting assembly, and any of such ways are encompassed by the present inventive subject matter. FIG. 11 depicts an embodiment which includes supplemental rails. In FIG. 11, each of the supplemental rails 21 extends through a hole (which has a periphery which corresponds to the cross-sectional periphery of the supplemental rail, i.e., a section taken in a plane which is perpendicular to the major dimensions of the rails) in an upwardly extending flange 27 of the light emitting element mounting assembly, and also extends through a bracket 28, whereby the supplemental rails 21 can move only in a direction which is parallel to the major dimensions of the rails. Each of the supplemental rails 21 also includes an upwardly extending structure 29 in which there is formed an opening 30. The light emitting element mounting assembly can therefore be mounted by attaching the upwardly extending structures to a construction element (e.g., a joist), for example by screws which extend through the openings 30 and into the construction element.

As noted above, according to a fourth aspect of the present inventive subject matter, there is provided a lighting fixture comprising a light emitting element mounting assembly, at least a first set of rails, and at least one engagement element attached to the light emitting element mounting assembly. The descriptions of rails herein are applicable to the rails in this aspect of the present inventive subject matter. Likewise, the descriptions of light emitting element mounting assemblies herein are applicable to the light emitting element mounting assemblies in this aspect of the present inventive subject matter.

As also noted above, the engagement element comprises at least a first engagement element portion and a second engagement element portion, the first engagement element portion being in contact with a first portion of the first rail, the second engagement element portion being in contact with a first portion of the second rail.

The engagement element, the first engagement element portion and the second engagement element portion can be formed of any desired material or materials, and can be shaped in any suitable way, so long as the first engagement element portion is in contact with the first portion of the first rail and the second engagement element portion is in contact with the first portion of the second rail, thereby creating at least some friction which inhibits motion of the first rail relative to the second rail to at least some degree.

As noted above, in some embodiments according to this aspect of the present inventive subject matter, the engagement element comprises a support element, a first pad and a second pad. In such embodiments, the support element and the first and second pads can be formed of any desired material or materials. As noted above, in some of such embodiments, the support element is spring biased such that the first pad exerts force on the first portion of the first rail and the second pad exerts force on the first portion of the second rail. Alternatively or additionally, the support element can further comprise a tensioning element which can be tightened to increase the force exerted by the first pad on the first portion of the first rail and to increase the force exerted by the second pad on the first portion of the second rail.

Figure 10:
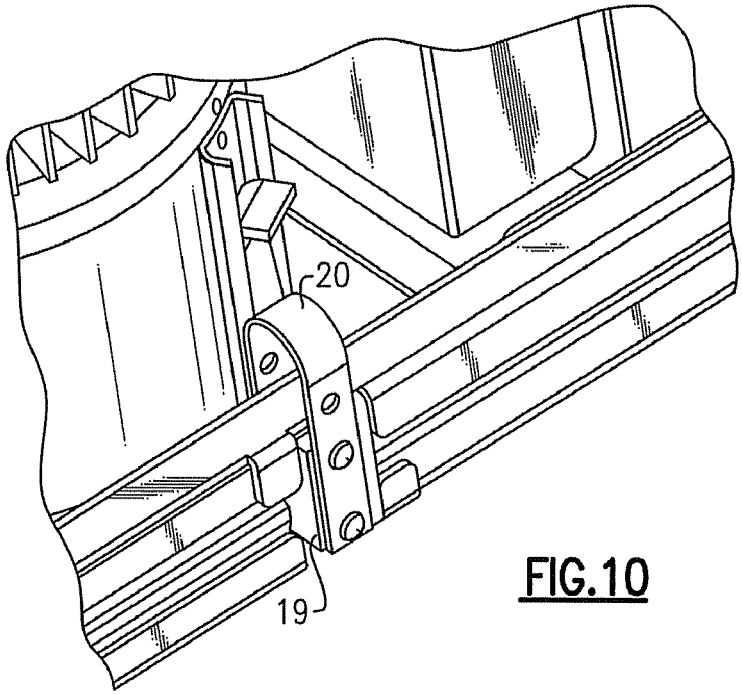
FIG. 10 is a close-up view of a portion of the embodiment depicted in FIG. 9.
Figure 14:
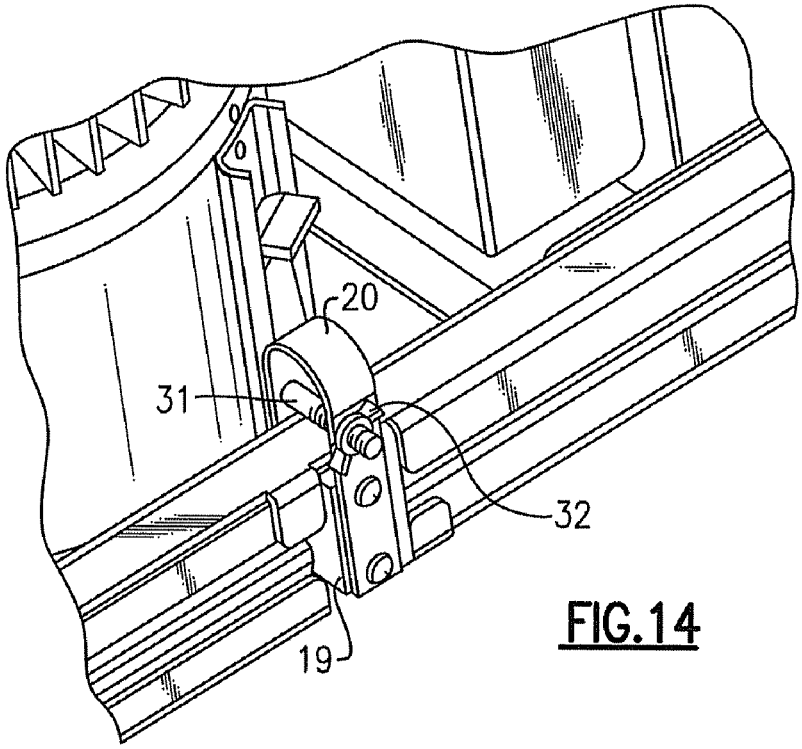
FIG. 14 is a close-up view of a portion of an embodiment according to the present inventive subject matter.

For example, the embodiment shown in FIG. 10 includes a support element 20, and first and second pads 19 (only one of the pads 19 being visible). The support element is spring biased so as to exert a force which pushes the first and second pads 19 toward each other (and therefore into the first and second rails, respectively). The embodiment shown in FIG. 14 is similar to the embodiment shown in FIG. 10, but the embodiment shown in FIG. 14 further includes a tensioning element in the form of a bolt 31 which extends through holes on either side of the support element (relative to the rails) and a wingnut 32 which can be tightened to a desired degree in order to select a desired degree of tension.

A representative example of the material out of which the pads can be made is rubber, in order to provide a relatively large amount of friction between the pads and the rails, thereby effectively inhibiting the rails from moving relative to one another.

The light emitting element (or light emitting elements), when present, employed in the devices according to the present inventive subject matter can be any suitable light emitting element. Representative examples of light emitting elements which can be employed in the devices according to the present inventive subject matter include:

U.S. Patent Application No. 60/752,753, filed on Dec. 21, 2005, entitled "LIGHTING DEVICE" (inventors: Gerald H. Negley, Antony Paul van de Ven and Neal Hunter) U.S. patent application Ser. No. 11/613,692, filed Dec. 20, 2006 (now U.S. Patent Publication No. 2007/0139923), the entireties of which are hereby incorporated by reference;

U.S. Patent Application No. 60/798,446, filed on May 5, 2006, entitled "LIGHTING DEVICE" (inventor: Antony Paul van de Ven) and U.S. patent application Ser. No. 11/743,754, filed May 3, 2007 (now U.S. Patent Publication No. 2007/0263393), the entireties of which are hereby incorporated by reference;

U.S. Patent Application No. 60/809,618, filed on May 31, 2006, entitled "LIGHTING DEVICE AND METHOD OF LIGHTING" (inventors: Gerald H. Negley, Antony Paul van de Ven and Thomas G. Coleman) and U.S. patent application Ser. No. 11/755,153, filed May 30, 2007 (now U.S. Patent Publication No. 2007/0279903), the entireties of which are hereby incorporated by reference;

U.S. Patent Application No. 60/845,429, filed on Sep. 18, 2006, entitled "LIGHTING DEVICES, LIGHTING ASSEMBLIES, FIXTURES AND METHODS OF USING SAME" (inventor: Antony Paul van de Ven), and U.S. patent application Ser. No. 11/856,421, filed Sep. 17, 2007 (now U.S. Patent Publication No. 2008/0084700), the entireties of which are hereby incorporated by reference;

U.S. Patent Application No. 60/846,222, filed on Sep. 21, 2006, entitled "LIGHTING ASSEMBLIES, METHODS OF INSTALLING SAME, AND METHODS OF REPLACING LIGHTS" (inventors: Antony Paul van de Ven and Gerald H. Negley) and U.S. patent application Ser. No. 11/859,048, filed Sep. 21, 2007 (now U.S. Patent Publication No. 2008/0084701), the entireties of which are hereby incorporated by reference;

U.S. Patent Application No. 60/858,558, filed on Nov. 13, 2006, entitled "LIGHTING DEVICE, ILLUMINATED ENCLOSURE AND LIGHTING METHODS" (inventor: Gerald H. Negley) and U.S. patent application Ser. No. 11/939,047, filed Nov. 13, 2007 (now U.S. Patent Publication No. 2008/0112183), the entireties of which are hereby incorporated by reference;

U.S. Patent Application No. 60/858,881, filed on Nov. 14, 2006, entitled "LIGHT ENGINE ASSEMBLIES" (inventors: Paul Kenneth Pickard and Gary David Trott) and U.S. patent application Ser. No. 11/939,052, filed Nov. 13, 2007 (now U.S. Patent Publication No. 2008/0112168), the entireties of which are hereby incorporated by reference;

U.S. Patent Application No. 60/859,013, filed on Nov. 14, 2006, entitled "LIGHTING ASSEMBLIES AND COMPONENTS FOR LIGHTING ASSEMBLIES" (inventors: Gary David Trott and Paul Kenneth Pickard) and U.S. patent application Ser. No. 11/939,059, filed Nov. 13, 2007 (now U.S. Patent Publication No. 2008/0112170), the entireties of which are hereby incorporated by reference;

U.S. Patent Application No. 60/853,589, filed on Oct. 23, 2006, entitled "LIGHTING DEVICES AND METHODS OF INSTALLING LIGHT ENGINE HOUSINGS AND/OR TRIM ELEMENTS IN LIGHTING DEVICE HOUSINGS" (inventors: Gary David Trott and Paul Kenneth Pickard) and U.S. patent application Ser. No. 11/877,038, filed Oct. 23, 2007 (now U.S. Patent Publication No. 2008/0106907), the entireties of which are hereby incorporated by reference;

U.S. Patent Application No. 60/861,901, filed on Nov. 30, 2006, entitled "LED DOWNLIGHT WITH ACCESSORY ATTACHMENT" (inventors: Gary David Trott, Paul Kenneth Pickard and Ed Adams), the entirety of which is hereby incorporated by reference;

U.S. Patent Application No. 60/916,384, filed on May 7, 2007, entitled "LIGHT FIXTURES, LIGHTING DEVICES, AND COMPONENTS FOR THE SAME" (inventors: Paul Kenneth Pickard, Gary David Trott and Ed Adams and U.S. patent application Ser. No. 11/948,041, filed Nov. 30, 2007 (now U.S. Patent Publication No. 2008/0137347), (inventors: Gary David Trott, Paul Kenneth Pickard and Ed Adams), the entireties of which are hereby incorporated by reference;

U.S. Patent Application No. 60/916,407, filed on May 7, 2007, entitled "LIGHT FIXTURES AND LIGHTING DEVICES" (inventors: Gary David Trott and Paul Kenneth Pickard), the entirety of which is hereby incorporated by reference;

U.S. Patent Application No. 60/990,439, filed on Nov. 27, 2007, entitled "HIGH EFFICIENCY LAMP" (inventors: Gerald H. Negley and Antony Paul van de Ven), the entirety of which is hereby incorporated by reference; and U.S. Patent Application No. 61/029,068, filed on Feb. 15, 2008, entitled "LIGHT FIXTURES AND LIGHTING DEVICES" (inventors: Paul Kenneth Pickard and Gary David Trott), and U.S. Patent Application No. 61/037,366, filed on Mar. 18, 2008 the entireties of which are hereby incorporated by reference.

As noted above, in some embodiments, the lighting fixture can comprise one or more solid state light emitters. Persons of skill in the art are familiar with a wide variety of solid state light emitters, and the present inventive subject matter encompasses the use of all of such solid state light emitters (optionally including luminescent material(s) in any suitable form). Representative examples of solid state light emitter which can be employed include those described in:

U.S. Patent Application No. 60/753,138, filed on Dec. 22, 2005, entitled "LIGHTING DEVICE" (inventor: Gerald H. Negley) and U.S. patent application Ser. No. 11/614,180, filed Dec. 21, 2006 (now U.S. Patent Publication No. 2007/0236911), the entireties of which are hereby incorporated by reference;

U.S. Patent Application No. 60/794,379, filed on Apr. 24, 2006, entitled "SHIFTING SPECTRAL CONTENT IN LEDS BY SPATIALLY SEPARATING LUMIPHOR FILMS" (inventors: Gerald H. Negley and Antony Paul van de Ven) and U.S. patent application Ser. No. 11/624,811, filed Jan. 19, 2007 (now U.S. Patent Publication No. 2007/0170447), the entireties of which are hereby incorporated by reference;

U.S. Patent Application No. 60/808,702, filed on May 26, 2006, entitled "LIGHTING DEVICE" (inventors: Gerald H. Negley and Antony Paul van de Ven) and U.S. patent application Ser. No. 11/751,982, filed May 22, 2007 (now U.S. Patent Publication No. 2007/0274080), the entireties of which are hereby incorporated by reference;

U.S. Patent Application No. 60/808,925, filed on May 26, 2006, entitled "SOLID STATE LIGHT EMITTING DEVICE AND METHOD OF MAKING SAME" (inventors: Gerald H. Negley and Neal Hunter) and U.S. patent application Ser. No. 11/753,103, filed May 24, 2007 (now U.S. Patent Publication No. 2007/0280624), the entireties of which are hereby incorporated by reference;

U.S. Patent Application No. 60/802,697, filed on May 23, 2006, entitled "LIGHTING DEVICE AND METHOD OF MAKING" (inventor: Gerald H. Negley) and U.S. patent application Ser. No. 11/751,990, filed May 22. 2007 (now U.S. Patent Publication No. 2007/0274063), the entireties of which are hereby incorporated by reference;

U.S. Patent Application No. 60/793,524, filed on Apr. 20, 2006, entitled "LIGHTING DEVICE AND LIGHTING METHOD" (inventors: Gerald H. Negley and Antony Paul van de Ven) and U.S. patent application Ser. No. 11/736,761, filed Apr. 18, 2007 (now U.S. Patent Publication No. 2007/0278934), the entireties of which are hereby incorporated by reference;

U.S. Patent Application No. 60/839,453, filed on Aug. 23, 2006, entitled "LIGHTING DEVICE AND LIGHTING METHOD" (inventors: Antony Paul van de Ven and Gerald H. Negley) and U.S. patent application Ser. No. 11/843,243, filed Aug. 22, 2007 (now U.S. Patent Publication No. 2008/0084685), the entireties of which are hereby incorporated by reference;

U.S. Patent Application No. 60/851,230, filed on Oct. 12, 2006, entitled "LIGHTING DEVICE AND METHOD OF MAKING SAME" (inventor: Gerald H. Negley) and U.S. patent application Ser. No. 11/870,679, filed Oct. 11, 2007 (now U.S. Patent Publication No. 2008/0089053), the entireties of which are hereby incorporated by reference;

U.S. Patent Application No. 60/916,608, filed on May 8, 2007, entitled "LIGHTING DEVICE AND LIGHTING METHOD" (inventors: Antony Paul van de Ven and Gerald H. Negley), the entirety of which is hereby incorporated by reference; and U.S. patent application Ser. No. 12/017,676, filed on Jan. 22, 2008 (now U.S. Patent Publication No. 2009/0108269), entitled "ILLUMINATION DEVICE HAVING ONE OR MORE LUMIPHORS, AND METHODS OF FABRICATING SAME" (inventors: Gerald H. Negley and Antony Paul van de Ven), U.S. Patent Application No. 60/982,900, filed on Oct. 26, 2007 (inventors: Gerald H. Negley and Antony Paul van de Ven), the entirety of which is hereby incorporated by reference.

Persons of skill in the art are familiar with a wide variety of ways to mount sources of visible light, mounting structures, schemes for mounting sources of visible light, housings for sources of visible light, etc., and any of such ways are within the scope of the present inventive subject matter. Representative examples of arrangements of sources of visible light, mounting structures, schemes for mounting sources of visible light, housings for sources of visible light, all of which are suitable for the lighting devices of the present inventive subject matter, are described in:

U.S. Patent Application No. 60/752,753, filed on Dec. 21, 2005, entitled "LIGHTING DEVICE" (inventors: Gerald H. Negley, Antony Paul van de Ven and Neal Hunter) and U.S. patent application Ser. No. 11/613,692, filed Dec. 20, 2006 (now U.S. Patent Publication No. 2007/0139923), the entireties of which are hereby incorporated by reference;

U.S. Patent Application No. 60/752,556, filed on Dec. 21, 2005, entitled "SIGN AND METHOD FOR LIGHTING" (inventors: Gerald H. Negley and Antony Paul van de Ven) and U.S. patent application Ser. No. 11/613,733, filed Dec. 20, 2006 (now U.S. Patent Publication No. 2007/0137074), the entireties of which are hereby incorporated by reference; and U.S. Patent Application No. 60/853,589, filed on Oct. 23, 2006, entitled "LIGHTING DEVICES AND METHODS OF INSTALLING LIGHT ENGINE HOUSINGS AND/OR TRIM ELEMENTS IN LIGHTING DEVICE HOUSINGS" (inventors: Gary David Trott and Paul Kenneth Pickard) and U.S. patent application Ser. No. 11/877,038, filed Oct. 23, 2007 (now U.S. Patent Publication No. 2008/0106907), the entireties of which are hereby incorporated by reference.

The present inventive subject matter provides the ability, if desired, to achieve a number of additional desirable effects, including (a)-(d) below:

(a) In a typical conventional can fixture, the lamp and can assemblies are separate. The can is permanently attached to the pan, and the lamp and trim are inserted after plaster and paint have been applied to the room. In some embodiments of a lighting fixture according to the present inventive subject matter, the elements providing mounting for the PCB (upper housing), supporting the reflector and lens (lower housing) are maintained in physical and thereby thermal contact with the can and an external heat sink to effectively manage solid state light emitter (e.g., LED) junction temperature. This is especially effective in a commercial environment where the plenum space actually serves as the air return. But even in residential applications, the ability to locate a heat sink externally to the can allows for more effective heat rejection than a heat sink inside the can.

(b) In a typical conventional can fixture, the can is included with the pan for rough-in. This allows the installer to put in the low-value part of the fixture (pan and can) prior to the finish work (i.e., plaster and paint work), and then install the high-value part of the fixture (lamp and trim) after finish work. But because the solid state light emitter driver and solid state light emitter board are tuned specifically to each other, and because the can, housings and heat sink are all tied together physically and thermally in this design, it would be desirable to make it possible to install the can assembly into the pan after the plaster and paint (finish work) is completed.

Figure 4:
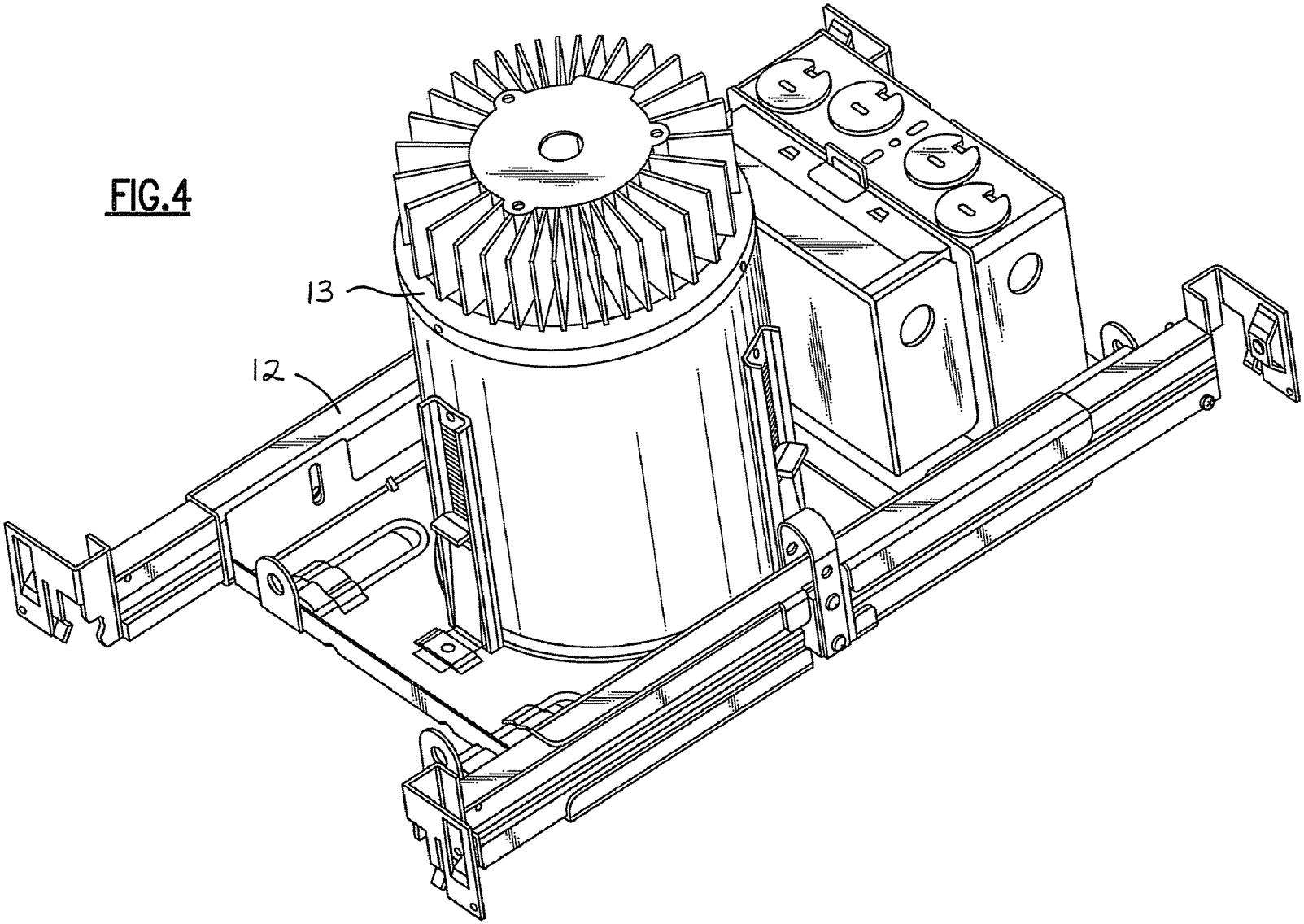
FIG. 4 depicts a third embodiment of a light fixture according to the present inventive subject matter.

In some embodiments according to the present inventive subject matter, there is provided a set of spring steel retainers in the pan and a set of slotted sheet metal brackets attached to the can to allow the power supply/driver and can (the high-value portion of the fixture) to be installed after finish work. The slots in the bracket, in some instances spaced minimally apart for more precise placement, interact with the spring steel clips to provide a ratcheting action as the can is inserted into the pan assembly. FIG. 3 depicts a representative example of an embodiment of a light emitting element mounting assembly (which can be referred to as a "pan assembly") 11 (without the mated can) according to the present inventive subject matter. FIG. 4 depicts such an embodiment of a pan assembly 12 with the mated can (also referred to herein as a light engine housing) 13 shown. FIG. 5 is a close-up view of a representative embodiment of a spring steel clip 14 and mating bracket 15 having slots 16 according to the present inventive subject matter.

(c) In a typical conventional fixture, a set of stamped sheet metal rails are provided to allow for the positioning of the can over the desired location. These sheet metal rails are designed primarily to be inexpensive, and suffer from multiple problems.

i) Sheet metal rails are usually relatively sharp. Repeated handling by the installer frequently results in nicks and cuts to the installers' hands.

ii) Sheet metal rails are usually relatively flimsy. Especially when extended to their full length, sheet metal rails typically provide minimal mechanical support to the pan assembly, allowing significant side-to-side and up-down play even after the set screw is tightened.

iii) Sheet metal rails use inconvenient sheet metal set screws to fix their positions. Standing on a ladder and adjusting rails to put a fixture into position, each set screw faces an opposite side. This means that typically, no matter where the installer stands on a ladder, at least one (and perhaps both) of the set screws will be in an awkward position to tighten. Combine this with the flimsy construction of the rails, and tightening the set screw becomes even more difficult.

Figure 7:
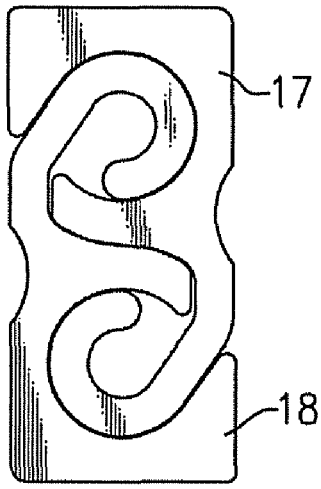
FIG. 7 depicts profiles of an embodiment of mated rails 17 and 18 according to the present inventive subject matter.
Figure 8:
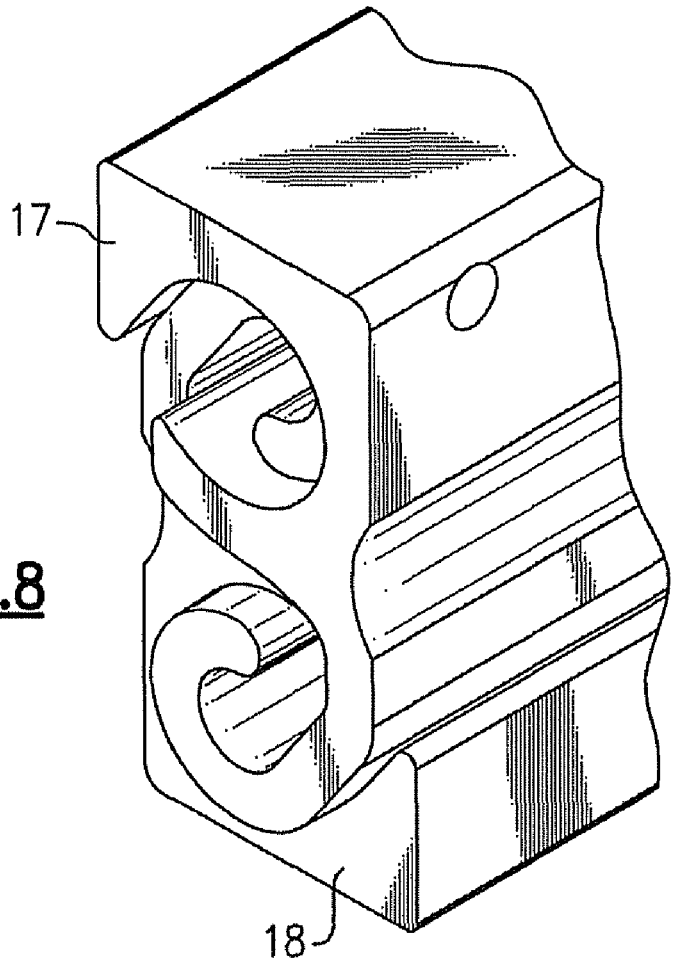
FIG. 8 depicts an isometric view of the mated rails 17 and 18 shown in FIG. 7.
Figure 9:
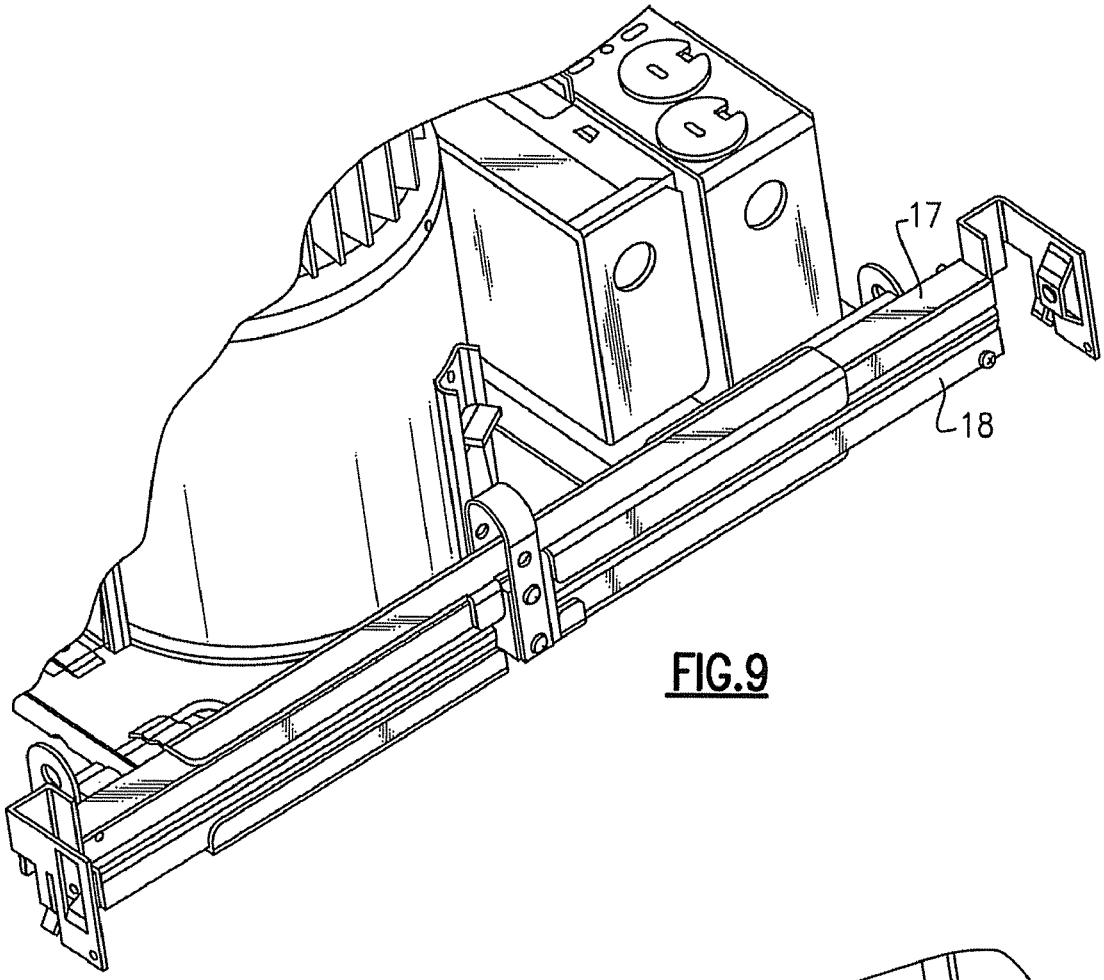
FIG. 9 depicts an embodiment which includes a first rail 17 and a second rail 18.

Some embodiments of the present inventive subject matter include one or more of the features described herein. One feature is the inclusion of one or more hermaphroditic element (made, e.g., of aluminum) made by extrusion. In a preferred aspect, a single extrusion is used for both mating components of the rail, minimizing tooling cost. In another aspect, the exterior surface of the rails is relatively smooth, thereby providing a component which is easy to handle in installation, eliminating typically installer cuts and nicks. In another aspect, the extrusion has a beam structure in both up-down and side-to-side bending, and it is much more rigid than any stamped sheet metal rail, providing effective support and positioning of the pan. FIG. 6 depicts a profile of an embodiment of a rail according to the present inventive subject matter; FIG. 7 depicts profiles of an embodiment of mated rails 17 and 18 according to the present inventive subject matter; FIG. 8 depicts an isometric view of the mated rails 17 and 18 shown in FIG. 7; and FIG. 9 depicts an embodiment in which such rails are installed in a pan.

Figure 16:
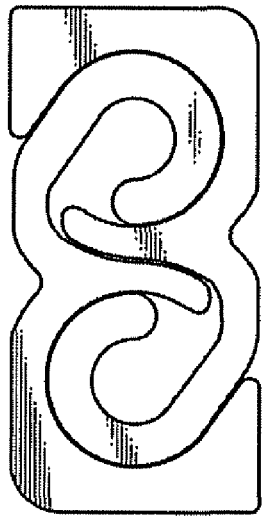
FIG. 16 depicts profiles of another embodiment of mated rails according to the present inventive subject matter.
Figure 17:
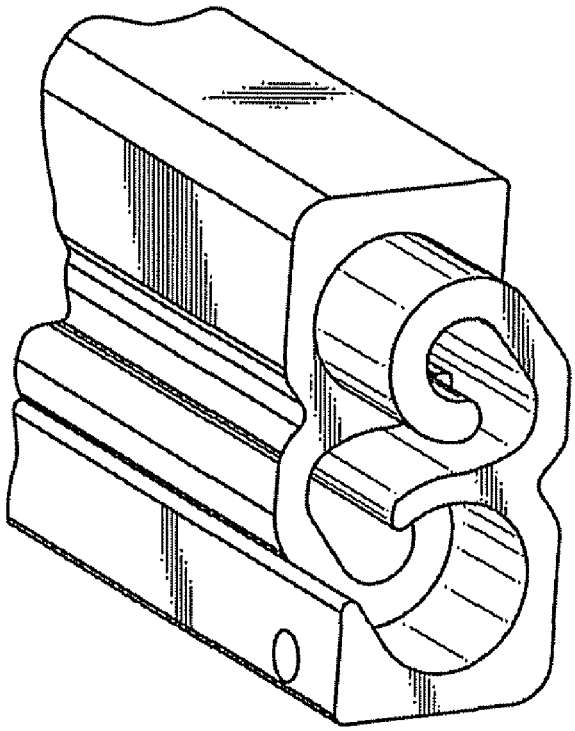
FIG. 17 depicts an isometric view of the mated rails shown in FIG. 16.

FIG. 16 depicts profiles of another embodiment of mated rails according to the present inventive subject matter. FIG. 17 depicts an isometric view of the mated rails shown in FIG. 16.

A further feature which is provided in some embodiments according to the present inventive subject matter is a rubber "rail brake" which impedes the movement of the rails with respect to each other. In some embodiments according to the present inventive subject matter, there is provided a spring component (made, e.g., of steel) which presses a soft pad (made, e.g., of durometer rubber) into the exterior edge of each rail. With effort, the friction created by the rubber pad can be overcome and the rails repositioned. (In contrast, sheet metal rails slide freely without the set screw in place, which can be inconvenient when trying to set the gross position of the can.) One or more thumbscrew per rail can, if desired, be provided, such that once the rails are in final position, the thumbscrew(s) can be tightened to provide additional impediment to rail movement if necessary or desired. FIG. 10 depicts an embodiment of a rail brake pad 19 and spring steel attachment component 20.

Figure 12:
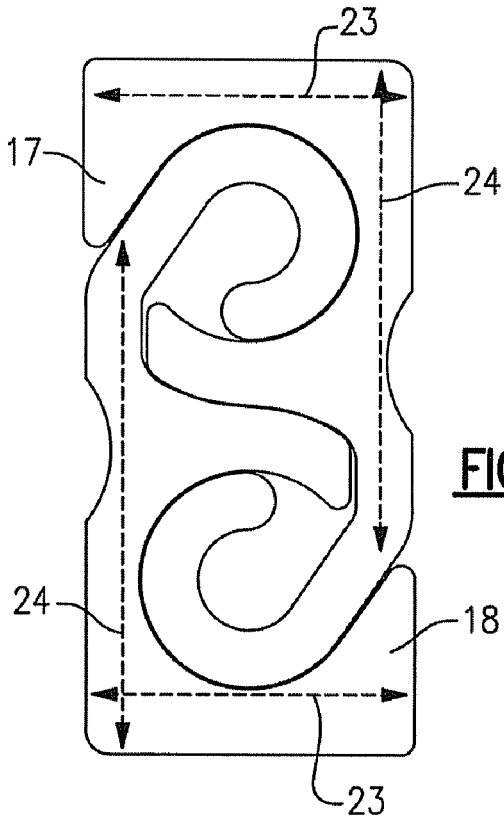
FIG. 12 depicts profiles of an embodiment of mated rails 17 and 18 according to the present inventive subject matter.

(d) In a typical fixture, a manufacturer might provide notches or score marks to allow an installer to shorten rails to fit a fixture in a very small joist space (typically less than 12-13".) Such a design requires the rails to be removed, modified, and reinstalled to fit the fixture in the small joist space. In some embodiments of the lighting fixtures according to the present inventive subject matter, a secondary set of sheet metal extensions is provided to fit these smaller spaces. When installing such embodiments, the installer can simply remove the rails and use the supplemental rails to attach the pan to the joists. FIG. 12 depicts an embodiment of a lighting fixture which includes supplemental rails 21 to allow for tight-space usage without the need for cutting or breaking existing rails.

Embodiments in accordance with the present inventive subject matter are described herein with reference to cross-sectional (and/or plan view) illustrations that are schematic illustrations of idealized embodiments of the present inventive subject matter. As such, variations from the shapes of the illustrations as a result, for example, of manufacturing techniques and/or tolerances, are to be expected. Thus, embodiments of the present inventive subject matter should not be construed as limited to the particular shapes of regions illustrated herein but are to include deviations in shapes that result, for example, from manufacturing. For example, a molded region illustrated or described as a rectangle will, typically, have rounded or curved features. Thus, the regions illustrated in the figures are schematic in nature and their shapes are not intended to illustrate the precise shape of a region of a device and are not intended to limit the scope of the present inventive subject matter.

FIG. 1 depicts a first embodiment of a lighting fixture according to the present inventive subject matter. This embodiment includes a light emitting element 10 mounted on a light emitting element mounting assembly 11 which includes a first set of rails comprising a first rail 17*a* and a second rail 18*a*, and a second set of rails comprising a first rail 17*b* and a second rail 18*b*. Each of the rails includes a bracket 33.

Figure 2:
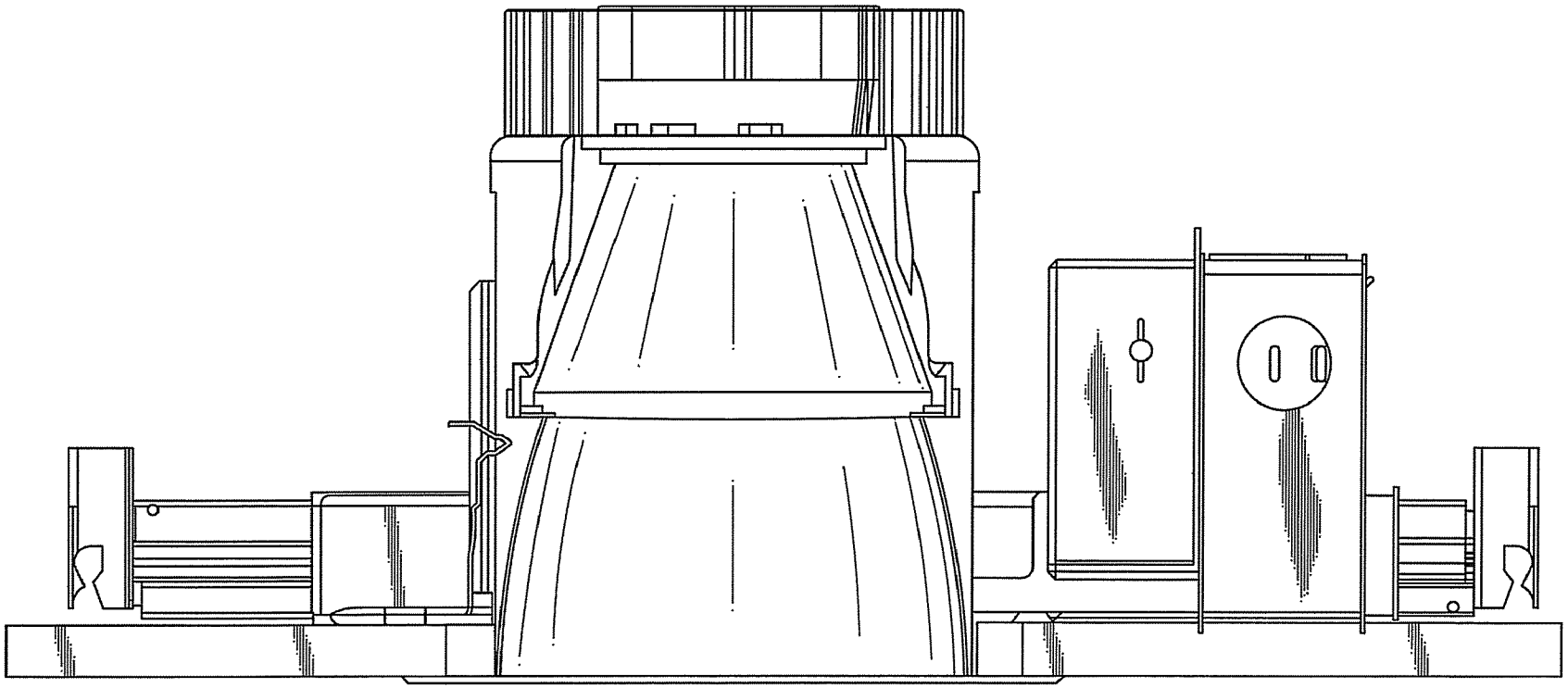
FIG. 2 is a cutaway view of the lighting fixture depicted in FIG. 1.

FIG. 2 is a cutaway view of the lighting fixture depicted in FIG. 1.

FIG. 3 depicts a second embodiment of a lighting fixture according to the present inventive subject matter, which includes a light emitting element mounting assembly 11 (and two sets of rails 17*a*, 18*a* and 17*b*, 18*b*), and the light emitting element mounting assembly 11 includes a receiving structure in the form of an opening 22. The embodiment depicted in FIG. 3 is similar to the embodiment shown in FIG. 1, except that in the embodiment shown in FIG. 1, a light emitting element (in the form of a can 10) is positioned within the opening 22.

FIG. 4 depicts a third embodiment of a light fixture according to the present inventive subject matter, which includes a light emitting element mounting assembly 12 with a light emitting element 13.

FIG. 5 is a close-up view of a portion of the third embodiment, which shows a spring clip 14 and a clip engagement structure 15 which has a plurality of clip engagement regions in the form of slots 16. In this embodiment, the spring clip 14 is mounted on the light emitting element mounting assembly 11 and the clip engagement structure is mounted on the light emitting element 10.

FIG. 6 depicts a profile of an embodiment of a rail according to the present inventive subject matter.

FIG. 7 depicts profiles of an embodiment of mated rails 17 and 18 according to the present inventive subject matter.

FIG. 8 depicts an isometric view of the mated rails 17 and 18 shown in FIG. 7.

FIG. 9 depicts an embodiment which includes a first rail 17 and a second rail 18.

FIG. 10 is a close-up view of a portion of the embodiment depicted in FIG. 9. The embodiment shown in FIG. 10 includes a support element 20, and first and second pads 19 (only one of the pads 19 being visible). The support element is spring biased so as to exert a force which pushes the first and second pads 19 toward each other (and therefore into the first and second rails, respectively).

FIG. 11 depicts an embodiment which includes a light emitting element mounting assembly 11 having a flange 27, and supplemental rails 21 each having an upwardly extending structure 29 with an opening 30 formed therein. The embodiment depicted in FIG. 11 also includes a flange 28 for each supplemental rail 21.

FIG. 12 is similar to FIG. 7, except that FIG. 12 is modified to show side-to-side beam structures with dotted lines 23 and up-down beam structures with dotted lines 24.

FIG. 13 depicts an embodiment of a lighting fixture according to the present inventive subject matter which is analogous to the embodiment depicted in FIG. 5, except that in FIG. 13, the spring clip is mounted on the light emitting element and the clip engagement structure is mounted on the light emitting element mounting assembly.

FIG. 14 is similar to the embodiment shown in FIG. 10, but the embodiment shown in FIG. 14 further includes a tensioning element in the form of a bolt 31 which extends through holes on either side of the support element (relative to the rails) and a wingnut 32 which can be tightened to a desired degree in order to select a desired degree of tension.

Furthermore, while certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

The invention claimed is:

1. A lighting fixture comprising:

a light emitting element mounting assembly;

at least a first set of rails, said first set of rails comprising a first rail and a second rail, said first rail and second rail each being connected to said light emitting element mounting assembly, at least one of said first rail and said second rail being slidable relative to said light emitting element mounting assembly, said first rail having a major dimension extending in a first direction, said second rail having a major dimension extending in a second direction, said first direction being substantially parallel to said second direction, said first rail being slidable relative to said second rail along said first direction, said first rail and said second rail each being extruded, said first rail having a first profile, said first profile comprising a first profile male component and a first rail female component, said second rail having a second profile, said second profile comprising a second profile male component and a second rail female component, said first profile male component being positioned within said second profile female component, said second profile male component being positioned within said first profile female component, wherein said second profile would be substantially similar to said first profile if said first profile were rotated 180 degrees.

2. A lighting fixture as recited in claim 1, wherein said first rail and said second rail each have a beam structure in both up-down and side-to-side bending.

3. A lighting fixture as recited in claim 1, wherein said first and second rails together have a combined external profile which is substantially rectangular.

4. A lighting fixture as recited in claim 1, wherein said lighting fixture further comprises a receiving structure to which a light emitting element can be connected.

5. A lighting fixture as recited in claim 1, wherein said lighting fixture further comprises a light emitting element.

6. A lighting fixture as recited in claim 1, wherein said lighting fixture further comprises at least one stop which prevents said first profile male component from sliding completely out of said second profile female component and which prevents said second profile male component from sliding completely out of said first profile female component.

7. A lighting fixture as recited in claim 1, wherein said first and second rails together have a combined external profile which is free from angles in excess of 90 degrees.

8. A lighting fixture as recited in claim 1, wherein said first rail female component extends greater than 180 degrees around said second rail male component, and said second rail female component extends greater than 180 degrees around said first rail male component.

9. A lighting fixture as recited in claim 1, wherein said lighting fixture further comprises at least one engagement element, said engagement element being attached to said light emitting element mounting assembly, said engagement element comprising at least a first engagement element portion and a second engagement element portion, said first engagement element portion being in contact with a first portion of said first rail, said second engagement element portion being in contact with a first portion of said second rail.

10. A lighting fixture as recited in claim 9, wherein said engagement element comprises a support element, a first pad and a second pad, said first pad being mounted on a first portion of said support element, said second pad being mounted on a second portion of said support element, said first pad comprising said first engagement element portion and being in contact with said first portion of said first rail, said second pad comprising said second engagement element portion and being in contact with said first portion of said second rail.

11. A lighting fixture comprising:

a light emitting element mounting assembly comprising an opening through which a light engine housing can be inserted, said light emitting element mounting assembly comprising at least one of (1) at least one spring clip and (2) at least one clip engagement structure.

12. A lighting fixture as recited in claim 11, wherein said clip engagement structure comprises at least one slot.

13. A lighting fixture as recited in claim 11, wherein said lighting fixture further comprises a light emitting element received in said opening.

14. A lighting fixture as recited in claim 13, wherein said light emitting element mounting assembly comprises at least a first spring clip, and said light emitting element comprises at least a first clip engagement structure, said first clip engagement structure comprising a plurality of clip engagement regions, said first spring clip engaging one of said clip engagement regions.

15. A lighting fixture as recited in claim 14, wherein at least a first pair of clip engagement regions are spaced from each other by a distance which is less than one-tenth of a major dimension of said light engine housing.

16. A lighting fixture as recited in claim 13, wherein said light emitting element comprises at least a first spring clip, and said light emitting element mounting assembly comprises at least a first clip engagement structure, said first clip engagement structure comprising a plurality of clip engagement regions, said first spring clip engaging one of said clip engagement regions.

17. A lighting fixture as recited in claim 16, wherein at least a first pair of clip engagement regions are spaced from each other by a distance which is less than one-tenth of a major dimension of said light engine housing.

18. A lighting fixture comprising:

a light emitting element mounting assembly;

at least a first set of rails, said first set of rails comprising a first rail and a second rail, said first rail and second rail each being connected to said light emitting element mounting assembly, at least one of said first rail and said second rail being slidable relative to said light emitting element mounting assembly, said first rail having a major dimension extending in a first direction, said second rail having a major dimension extending in a second direction, said first direction being substantially parallel to said second direction, said first rail being slidable relative to said second rail along said first direction; and at least a first supplemental rail, said first supplemental rail being slidable relative to said light emitting element mounting assembly along a third direction, said third direction being parallel to said first direction.

19. A lighting fixture comprising:

a light emitting element mounting assembly;

at least a first set of rails, said first set of rails comprising a first rail and a second rail, said first rail and second rail each being connected to said light emitting element mounting assembly, at least one of said first rail and said second rail being slidable relative to said light emitting element mounting assembly, said first rail having a major dimension extending in a first direction, said second rail having a major dimension extending in a second direction, said first direction being substantially parallel to said second direction, said first rail being slidable relative to said second rail along said first direction; and at least one engagement element, said engagement element being attached to said light emitting element mounting assembly, said engagement element comprising at least a first engagement element portion and a second engagement element portion, said first engagement element portion being in contact with a first portion of said first rail, said second engagement element portion being in contact with a first portion of said second rail.

20. A lighting fixture as recited in claim 19, wherein said engagement element comprises a support element, a first pad and a second pad, said first pad being mounted on a first portion of said support element, said second pad being mounted on a second portion of said support element, said first pad comprising said first engagement element portion and being in contact with said first portion of said first rail, said second pad comprising said second engagement element portion and being in contact with said first portion of said second rail.

21. A lighting fixture as recited in claim 20, wherein said support element is spring biased such that said first pad exerts force on said first portion of said first rail and said second pad exerts force on said first portion of said second rail.

22. A lighting fixture as recited in claim 21, wherein said support element further comprises a tensioning element which can be tightened to increase the force exerted by said first pad on said first portion of said first rail and to increase the force exerted by said second pad on said first portion of said second rail.

23. A lighting fixture as recited in claim 20, wherein said support element further comprises a tensioning element which can be tightened to cause said first pad to exert force on said first portion of said first rail and said second pad to exert force on said first portion of said second rail.

* * * * *